US008142269B2

(12) United States Patent
Tsukahara

(10) Patent No.: US 8,142,269 B2
(45) Date of Patent: Mar. 27, 2012

(54) GAMING MACHINE FOR RACING GAME AND PLAYING METHOD THEREOF

(75) Inventor: Nakayasu Tsukahara, Koto-ku (JP)

(73) Assignee: Universal Entertainment Corporation, Tokyo (JP)

( * ) Notice: Subject to any disclaimer, the term of this patent is extended or adjusted under 35 U.S.C. 154(b) by 557 days.

(21) Appl. No.: 12/403,973

(22) Filed: Mar. 13, 2009

(65) Prior Publication Data

US 2009/0233671 A1 Sep. 17, 2009

Related U.S. Application Data

(60) Provisional application No. 61/036,344, filed on Mar. 13, 2008.

(51) Int. Cl.
*A63F 9/24* (2006.01)

(52) U.S. Cl. ..... 463/6; 463/25; 463/31; 463/42

(58) Field of Classification Search ..... None
See application file for complete search history.

(56) References Cited

U.S. PATENT DOCUMENTS 4,712,799 A * 12/1987 Fraley ..... 463/20
5,324,035 A * 6/1994 Morris et al. ..... 463/42
5,611,730 A * 3/1997 Weiss ..... 463/20
5,639,088 A * 6/1997 Schneider et al. ..... 273/138.2
5,820,459 A * 10/1998 Acres et al. ..... 463/25
6,001,016 A * 12/1999 Walker et al. ..... 463/42
6,142,874 A * 11/2000 Kodachi et al. ..... 463/20
6,234,896 B1 * 5/2001 Walker et al. ..... 463/16
6,254,483 B1 * 7/2001 Acres ..... 463/26
6,257,981 B1 * 7/2001 Acres et al. ..... 463/26
6,273,820 B1 * 8/2001 Haste, III ..... 463/40
6,692,360 B2 * 2/2004 Kusuda et al. ..... 463/42
6,695,697 B1 * 2/2004 Okada ..... 463/20

(Continued)

OTHER PUBLICATIONS

U.S. Appl. No. 12/480,272, filed Jun. 8, 2009, Tsukahara.

(Continued)

*Primary Examiner* — David E Graybill
(74) *Attorney, Agent, or Firm* — Oblon, Spivak, McClelland, Maier & Neustadt, L.L.P.

(57) ABSTRACT

A gaming machine displays on a display a horse racing game in which racehorses race against each other, and receives, via a gaming terminal, a bet made by a player regarding an order of arrival of the racehorses in the horse racing game. Thereafter, the gaming machine periodically calculates odds for the horse racing game. While remaining time to reception deadline for bets is a certain length of time or more, a value obtained by reducing the calculated actual value of odds by a predetermined proportion is displayed on the display as an effect value of the odds at that point. The longer the remaining time to the bet reception deadline, the larger the predetermined proportion reduced from the actual value of the odds to obtain the effect value. Moreover, the gaming machine displays on the display the calculated actual value of the odds as the effect value when a certain length of time or less remains before the bet reception deadline.

18 Claims, 17 Drawing Sheets

U.S. PATENT DOCUMENTS

| | | | | |
|---|---|---|---|---|
| 6,699,126 | B2 * | 3/2004 | Kusuda | 463/42 |
| 6,935,949 | B1 * | 8/2005 | Murphy | 463/20 |
| 7,273,415 | B2 * | 9/2007 | Cregan et al. | 463/25 |
| 2001/0016509 | A1 | 8/2001 | Kusuda | |
| 2002/0010017 | A1 * | 1/2002 | Bennett | 463/20 |
| 2002/0010023 | A1 * | 1/2002 | Kusuda et al. | 463/42 |
| 2002/0013175 | A1 * | 1/2002 | Kusuda | 463/42 |
| 2003/0069073 | A1 * | 4/2003 | Okada | 463/42 |
| 2007/0123332 | A1 * | 5/2007 | Hishinuma et al. | 463/16 |
| 2007/0238510 | A1 * | 10/2007 | Halprin | 463/20 |
| 2008/0234033 | A1 * | 9/2008 | Berman et al. | 463/20 |
| 2009/0075717 | A1 * | 3/2009 | Jaffe | 463/20 |
| 2009/0280890 | A1 * | 11/2009 | Jaffe | 463/20 |
| 2010/0056237 | A1 * | 3/2010 | Fraser | 463/6 |

OTHER PUBLICATIONS

U.S. Appl. No. 12/183,531, filed Jul. 31, 2008, Tsukahara.

U.S. Appl. No. 12/469,464, filed May 20, 2009, Tsukahara.

* cited by examiner

GAMING MACHINE FOR RACING GAME AND PLAYING METHOD THEREOF

CROSS REFERENCE TO RELATED APPLICATIONS

This application claims priority to U.S. provisional patent application Ser. No. 61/036,344 filed on Mar. 13, 2008, and which is incorporated by reference herein for all purposes.

BACKGROUND OF THE INVENTION

1. Field of the Invention

The present invention relates to a gaming machine for a racing game in which a plurality of characters race against each other, and a playing method thereof.

2. Description of the Related Art

Among gaming machines for racing games, such as a horse race, in which a plurality of characters race against each other, there is a gaming machine which displays contents of odds on a display thereof while updating the odds to the latest values in real time, as described in U.S. Patent Application Publication No. 2001/0016509.

In such a gaming machine, the contents of the odds to be displayed on the display are changed depending on how players has made bets on an order of arrival so far.

SUMMARY OF THE INVENTION

It is an object of the present invention to provide a gaming machine for a racing game in which a plurality of characters race against each other, the gaming machine being capable of providing new entertainment properties by announcing odds to players on a display with a mild change in the odds in response to bets made by players.

The first aspect of the present invention is a gaming machine comprising: a display adapted to display a racing game in which a plurality of characters race against each other; a gaming terminal configured to receive a bet made by a player regarding an order of arrival of the plurality of characters in the racing game; and a controller configured to (a) periodically sum up bets made by players and received by the gaming terminal, (b) periodically calculate a latest value of odds for the racing game on the basis of a latest sum-up result of the bets, and (c) display on the display the odds for the racing game as an effect value smaller than the latest value by a predetermined rate in a time period with more than predetermined time left to a deadline for the bets.

The second aspect of the present invention is a gaming machine comprising: a shared display device adapted to display a racing game in which a plurality of characters race against each other; a gaming terminal configured to receive a bet made by a player regarding an order of arrival of the plurality of characters in the racing game; and a controller configured to (a) periodically sum up bets made by players and received by the gaming terminal, (b) periodically calculate a latest value of odds for the racing game on the basis of a latest sum-up result of the bets, and (c) display, on an individual display of the gaming machine, the odds for the racing game as an effect value smaller than the latest value by a predetermined rate in a time period with more than predetermined time left to a deadline for the bets.

The third aspect of the present invention is a gaming machine comprising: a shared display device adapted to display a racing game in which a plurality of characters race against each other; a gaming terminal configured to receive a bet made by a player regarding an order of arrival of the plurality of characters in the racing game; and a controller configured to (a) periodically sum up bets made by players and received by the gaming terminal, (b) periodically calculate a latest value of odds for the racing game on the basis of a latest sum-up result of the bets, and (c) display, on the shared display device and an individual display of the gaming machine, the odds for the racing game as an effect value smaller than the latest value by a predetermined rate in a time period with more than predetermined time left to a deadline for the bets.

The fourth aspect of the present invention is a method for playing a gaming machine, the method comprising the steps of: displaying on a display a racing game in which a plurality of characters race against each other; receiving, by a gaming terminal, a bet made by a player regarding an order of arrival of the plurality of characters in the racing game; periodically summing up bets made by players and received by the gaming terminal; periodically calculating the latest value of odds for the racing game on the basis of a latest sum-up result of the bets; displaying an effect value of the odds for the racing game on the display; and setting the effect value smaller than the latest value by a predetermined rate in a time period with more than predetermined time left to a deadline for the bets.

The fifth aspect of the present invention is a method for playing a gaming machine, the method comprising the steps of: displaying on a shared display device a racing game in which a plurality of characters race against each other; receiving, by a gaming terminal, a bet made by a player regarding an order of arrival of the plurality of characters in the racing game; periodically summing up bets made by players and received by the gaming terminal; periodically calculating the latest value of odds for the racing game based on the latest sum-up result of the bets; displaying an effect value of the odds for the racing game on an individual display of the gaming machine; and setting the effect value smaller than the latest value by a predetermined rate in a time period with more than predetermined time left to a deadline for the bets.

The sixth aspect of the present invention is a method for playing a gaming machine, the method comprising the steps of: displaying on a shared display device a racing game in which a plurality of characters race against each other; receiving, by a gaming terminal, a bet made by a player regarding an order of arrival of the plurality of characters in the racing game; periodically summing up bets made by player and received by the gaming terminal; periodically calculating the latest value of odds for the racing game on the basis of the latest sum-up result of the bets; displaying an effect value of the odds for the racing game on the shared display device and an individual display of the gaming machine; and setting the effect value smaller than the latest value by a predetermined rate in a time period with more than predetermined time left to a deadline for the bets.

DETAILED DESCRIPTION OF THE EMBODIMENT

In a related racing game, for example, in which a plurality of characters such as racehorses and race boats race against each other, odds provided to players who make bets on the order of arrival of the characters may be significantly changed every time each player makes a bet. The present invention is, for example, intended to prevent a player who has already made a bet based on the odds from losing his/her motivation due to the significant change in the odds. Embodiments of the present invention will be described with reference to the accompanying drawings hereinafter.

Figure 1:
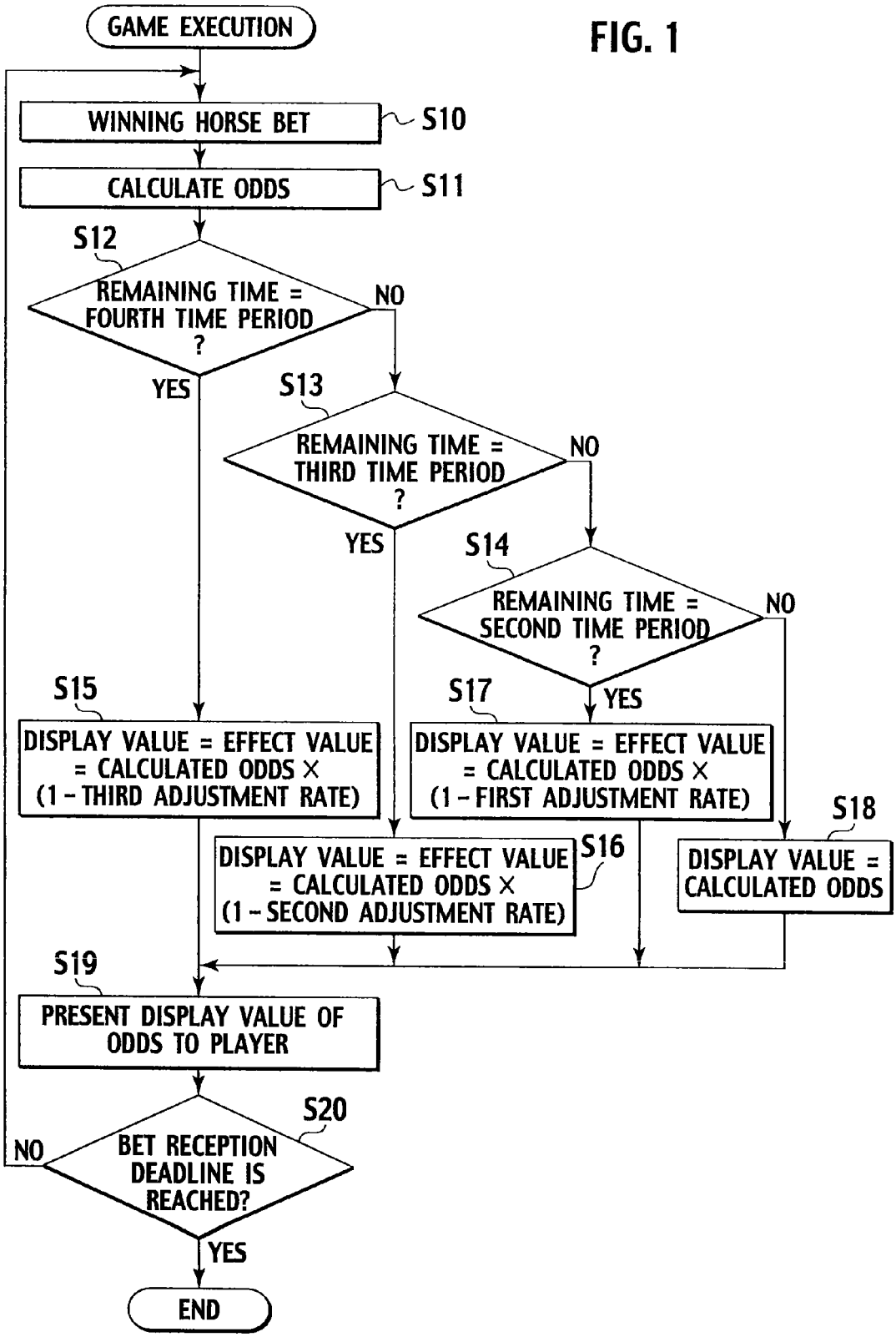
FIG. 1 is a flowchart schematically showing steps of a method for playing a gaming machine according to first to third embodiments of the present invention.
Figure 2:
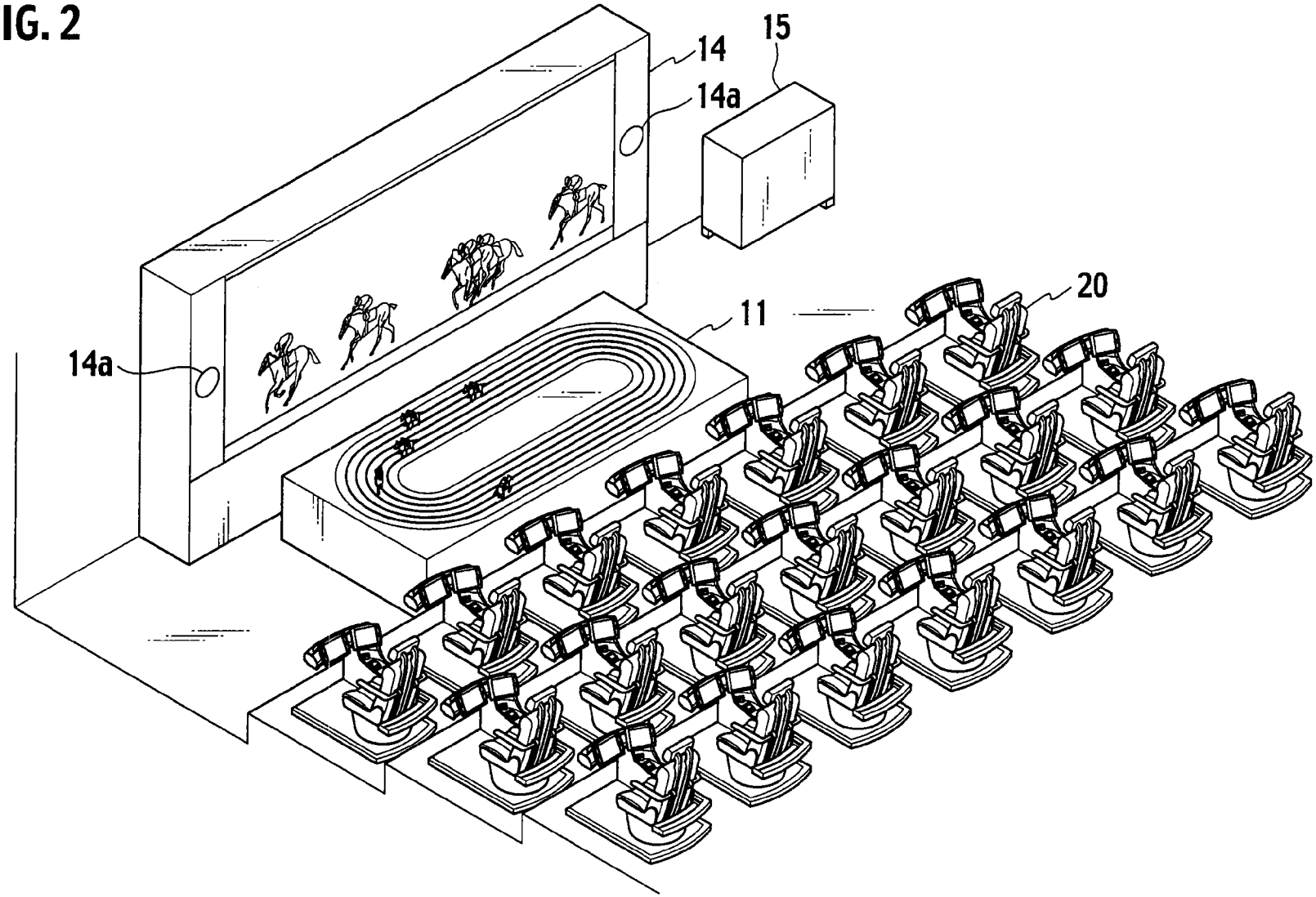
FIG. 2 is an external view of a gaming machine according to the first embodiment of the present invention.
Figure 3:
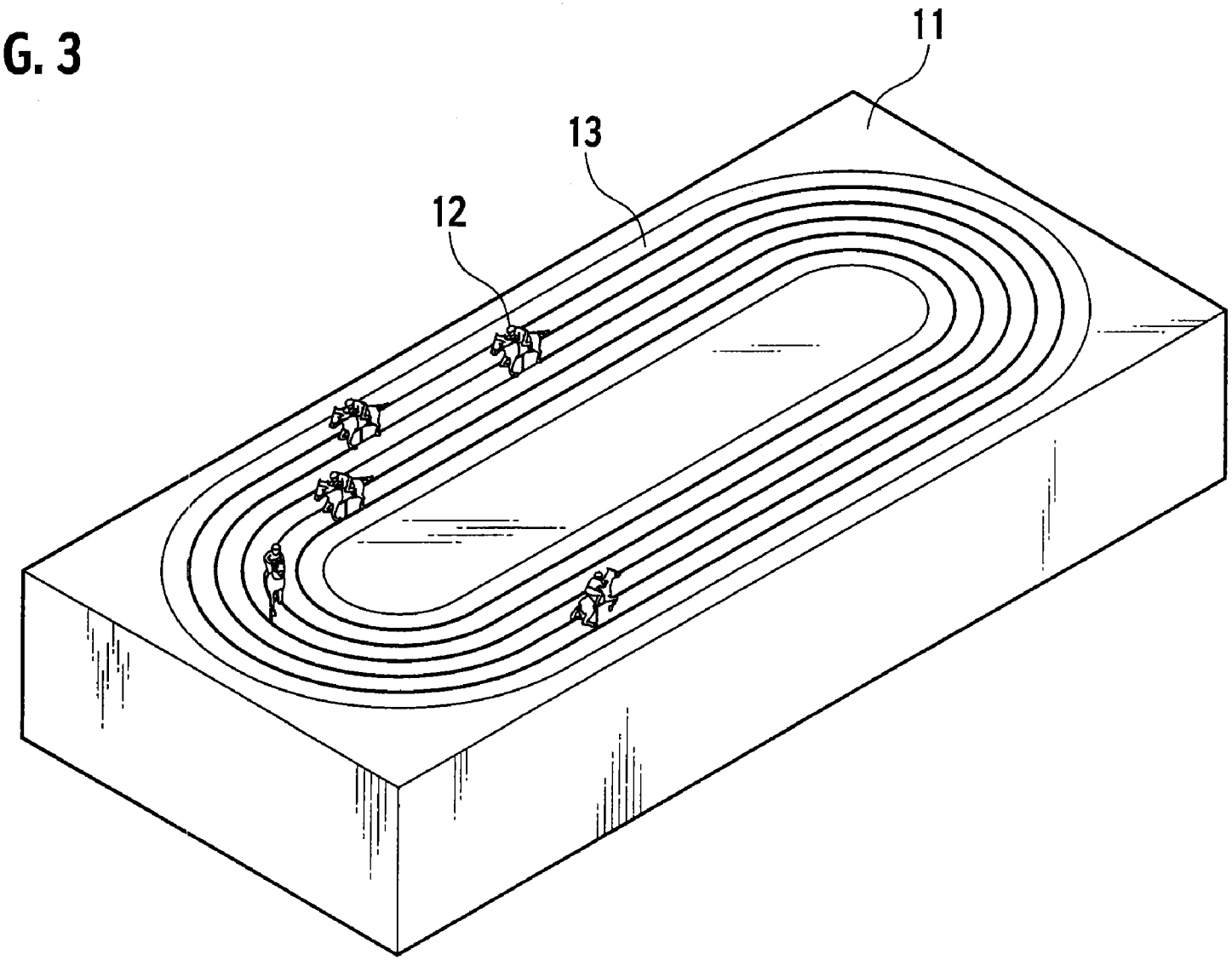
FIG. 3 is an external view of a model unit in the gaming machine according to the first embodiment of the present invention.
Figure 4:
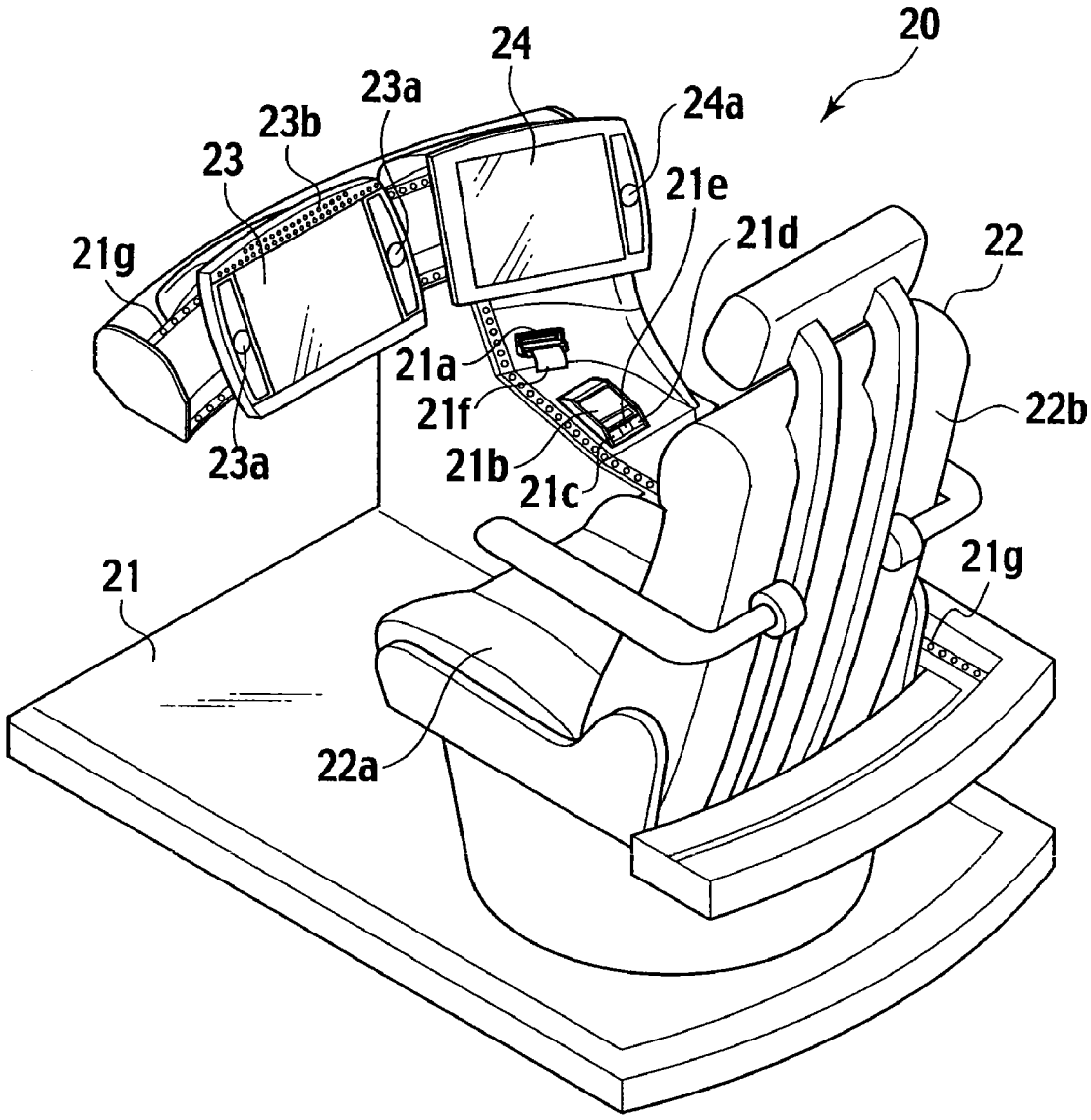
FIG. 4 is an external view of a gaming terminal in the gaming machine according to the first embodiment of the present invention.
Figure 5:
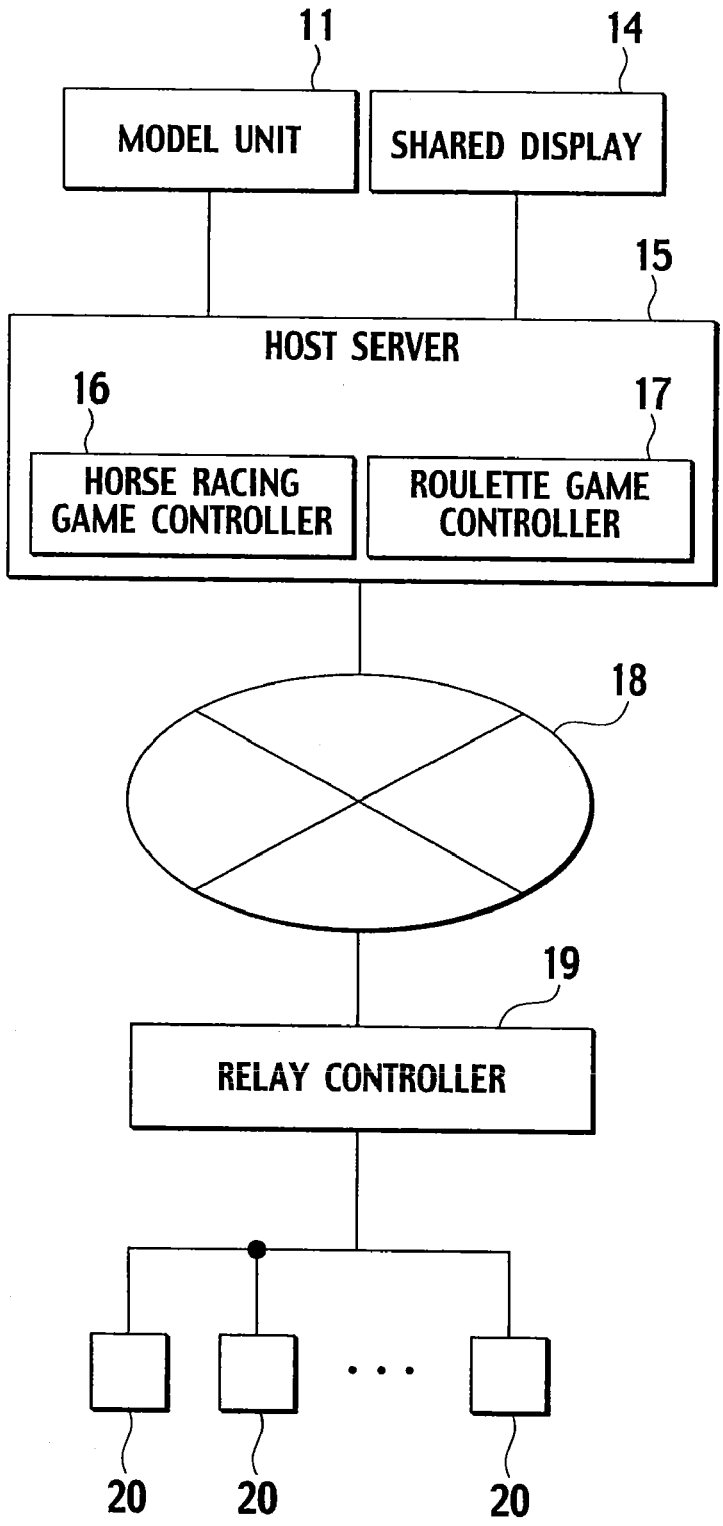
FIG. 5 is a network configuration diagram of the gaming machine according to the first embodiment of the present invention.

FIG. 1 is a flowchart schematically showing a method for playing a gaming machine according to first to third embodiments of the present invention. FIG. 2 is an external view of a gaming machine according to the first embodiment of the present invention. FIG. 3 is an external view of a model unit shown in FIG. 2. FIG. 4 is an external view of a gaming terminal shown in FIG. 2. FIG. 5 is a network configuration diagram of the gaming machine shown in FIG. 2. With reference to FIGS. 1 to 5, the embodiments of the present invention will be schematically described below by taking the case where the present invention is applied to a horse racing game.

The gaming machine and a playing method thereof according to the present invention can be achieved by use of a gaming machine 10 according to the first embodiment of the present invention shown in FIG. 2, for example. In the gaming machine 10, a host server 15 performs a horse racing game by use of a model unit 11. In the horse racing game, a player who predicts an order of arrival of racehorses 12, 12, . . . on the model unit 11 shown in FIG. 3 can make a bet (can give a vote/can make a selection) regarding the order of arrival of the racehorses 12, 12, . . . at each of gaming terminals 20, 20, . . . shown in FIG. 4, which are connected to the host server 15 through a network 18 and a relay controller 19 shown in FIG. 5.

The gaming machine and the playing method thereof according to the embodiments of the present invention, which can be achieved by use of the gaming machine 10 described above, is characterized by contents of odds to be displayed on a display in a time period in which the player can make a bet. This display can be formed of, for example, a shared display 14 shown in FIG. 2, which is connected to the host server 15, or an individual display 23 provided in each of the gaming terminals 20, 20, . . . shown in FIG. 4.

First, in the method for playing a gaming machine according to the first to third embodiments of the present invention, as shown in the flowchart of FIG. 1, winning horse betting is performed by the player (Step S10). This winning horse betting is performed by inputting betting contents at each of the gaming terminals 20, 20, . . . . The betting contents of the winning horse betting are notified to the host server 15 from each of the gaming terminals 20, 20, . . . .

Next, odds for each of betting patterns, in which the player can make a bet on a next horse racing game, are calculated, by the host server 15, by use of a predetermined calculation formula and the like (Step S11). The odds can be represented by a payout ratio in the case where one unit of game media, such as currencies, credits and coins, is bet, for example. Moreover, this payout ratio can include or not include original funds for the bet. In the present specification, the payout ratio including the original funds will be described as the odds.

Next, the host server 15 determines which one of first to fourth time periods a remaining time belongs to (Steps S12 to S14), where the remaining time is defined as a time up to a bet reception deadline, which is immediately before start of the horse racing game. Here, the first time period is a time period with shortest time left (for example, 0 to 30 seconds left) to the bet reception deadline, the second time period is a time period prior thereto (for example, 30 seconds to 1 minute and 30 seconds left), the third time period is a time period prior thereto (for example, 1 minute and 30 seconds to 3 minutes left), and the fourth time period is a time period other than the first to third time periods (for example, over 3 minutes left).

If the remaining time is in the fourth time period (YES in Step S12), an effect value obtained by reducing a value of the odds calculated in Step S11 by a third adjustment rate (for example, 30%) is determined to be a display value of the odds (Step S15). Moreover, if the remaining time is in the third time period (NO in Step S12 and YES in Step S13), an effect value obtained by reducing the value of the odds calculated in Step S11 by a second adjustment rate (for example, 20%) is determined to be the display value of the odds (Step S16).

Furthermore, if the remaining time is in the second time period (NO in both Steps S12 and S13, and YES in Step S14), an effect value obtained by reducing the value of the odds calculated in Step S11 by a first adjustment rate (for example, 10%) is determined to be the display value of the odds (Step S17). Moreover, if the remaining time is in the first time period (NO in all of the above Steps S12 to S14), the latest value of the odds calculated in Step S11 is determined to be the display value of the odds (Step S18).

Subsequently, in Step S19, the display value determined in Steps S15 to S18 is presented to the player. This presentation can be performed by displaying the value on the shared display 14 (see FIG. 2) or by displaying the value on the individual display 23 (see FIG. 4) which is provided in each of the gaming terminals 20, 20, . . . . Alternatively, the odds can also be presented by displaying the value thereof on both of the shared display 14 and the individual display 23.

The presentation, to the player in Step S19, of the display value of the odds determined by the procedures in Steps S10 to S18 described above is periodically repeated until the bet reception deadline comes (NO in Step S20). When the bet reception deadline comes (YES in Step S20), the series of procedures are terminated.

In a racing game for which the playing method of the embodiments of the present invention as described above is executed, the number of bets is much smaller than that in an actual race such as a horse race that takes place at a horse racing track, for example. Thus, a change (reduction in many cases) in the odds when the number of bets is increased is much more significant than that in the actual race.

However, according to the playing method of the embodiments of the present invention, the effect value smaller than the actual odds by a predetermined rate is presented as the odds to the player in the time period with predetermined time left to the deadline for betting. Thus, even if the actual odds are significantly changed (reduced in many cases) by the increase in the number of bets, a range of change in the effect value presented as the odds to the player is relatively small.

Therefore, for example, even if a large amount of bets are made like last-minute bets almost concurrently just before the deadline for betting, the effect value provided as the odds to the player is prevented from being changed as significantly as the actual odds. Accordingly, the player is prevented from losing motivation for the racing game due to the change in the odds after betting. Thus, entertainment properties of the racing game can be improved.

Next, detailed description will be given of the configuration of the gaming machine according to the first embodiment of the present invention in the case where the present invention is applied to a horse racing game. FIG. 2 is a perspective view showing the configuration of the gaming machine according to the first embodiment of the present invention. As shown in FIG. 2, the gaming machine 10 is for playing a horse racing game as a racing game, and includes the model unit 11, the shared display 14, the host server 15 and the plurality of gaming terminals 20, 20, . . . .

As shown in FIG. 3, the model unit 11 has a plurality of model racehorses 12, 12 . . . running on a model course 13. The racehorses 12 are individually driven by control executed by a horse racing game controller 16 (see FIG. 6) to be described later in the host server 15.

The shared display 14 shown in FIG. 2 displays a live screen of a race taking place on the model unit 11, an image of a paddock before the race, odds and the like behind the model unit 11. On both left and right sides of a display screen of the shared display 14, speaker units 14*a* are provided, respectively.

The host server 15 includes: the horse racing game controller 16 (see FIG. 6) which is operated so as to execute the horse racing game on the model unit 11 and the shared display 14; and a roulette game controller 17 (see FIG. 7) which is operated so as to execute a roulette game at each of the gaming terminals 20.

The plurality of gaming terminals 20, 20, . . . are arranged in front of the model unit 11 and the shared display 14. As shown in FIG. 4, each of the gaming terminals 20 has a box unit 21, a seat 22 and two individual displays 23 and 24.

The box unit 21 includes: a bill insertion slot 21*a*; a coin insertion slot 21*b*; buttons 21*c* and 21*d* for opening and closing the coin insertion slot 21*b*; a counting start button 21*e* for instructing to start counting coins inserted into the coin insertion slot 21*b*; a ticket printer 21*f*, and a plurality of white LEDs 21*g* for effects, which are arranged in a line.

The seat 22 is a semi-bucket seat having a backrest part 22*b* that can be reclined relative to a sitting part 22*a*. In both of the sitting part 22*a* and the backrest part 22*b*, vibration generating units 22*c* and 22*d* (see FIG. 9) are installed. These vibration generating units 22*c* and 22*d* can generate vibration when a specific point comes during the horse racing game, the specific point being arbitrarily set by the player.

The individual display 23 has stereo speakers 23*a* and a plurality of white LEDs 23*b* for effects. The individual display 23 displays various images related to the horse racing game played by use of the model unit 11. Moreover, winning horse betting in the horse racing game can be performed on a bet reception screen displayed on the individual display 23.

Figure 14:
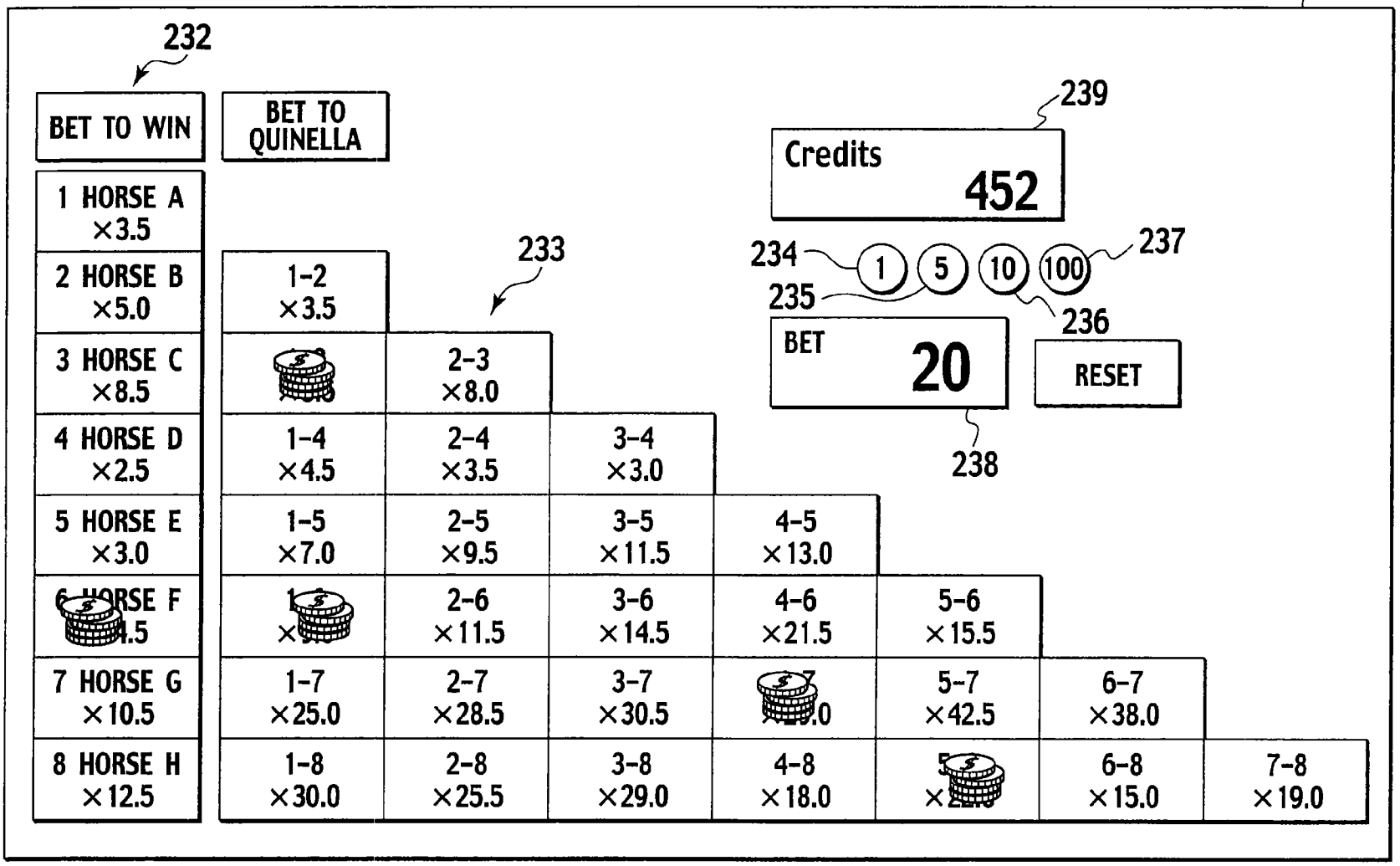
FIG. 14 is an explanatory view showing an example of a bet reception screen in a horse racing game displayed in the gaming terminal of the gaming machine according to the first embodiment of the present invention.

FIG. 14 shows an example of the bet reception screen for the winning horse betting in the horse racing game displayed on the individual display 23. On a reception screen 231, odds tables 232 and 233 for "bet to win" and "bet to quinella" are displayed. The player can perform a bet operation by touching a desired portion on the odds tables 232 and 233 to select contents of a winning horse bet to be made and then by touching one of bet number screens 234, 235, 236 and 237, which are "1", "5", "10" and "100", respectively, on the reception screen to specify the number of credits to be bet. A current total amount of bet is displayed on a bet amount display 238. On a reception screen 231, the display value (effect value) of the odds is, for example, "×3.5" for "1 HORSE A" in the odds table 232 for "bet to win". Similarly, on a reception screen 231, the display value (effect value) of the odds is, for example, "×4.5" for "1-4" in the odds table 233 for "bet to quinella".

The individual display 24 displays various images related to a sub-game other than the horse racing game. In this embodiment, the sub-game is a roulette game, and only the player who has made the winning horse bet on the horse racing game on the individual display 23 in the gaming terminal 20 can join the roulette game displayed on the individual display 24. The individual display 24 has a monaural speaker 24*a*.

The individual display 24 displays various images related to the roulette game. In the roulette game, a bet can be made on a bet reception screen displayed on the individual display 24. Moreover, an outcome of the roulette game can also be confirmed on the individual display 24.

FIG. 5 is a network connection diagram of the gaming machine according to this embodiment. As shown in FIG. 5, the host server 15 is connected to the relay controller 19 through the network 18, and the relay controller 19 is connected to each of the gaming terminals 20. Moreover, data can be transmitted and received between each of the gaming terminals 20 and the host server 15 through the network 18.

Moreover, the host server 15 includes the horse racing game controller 16 and the roulette game controller 17. Furthermore, the host server 15 is connected to the model unit 11 and the shared display 14.

Figure 6:
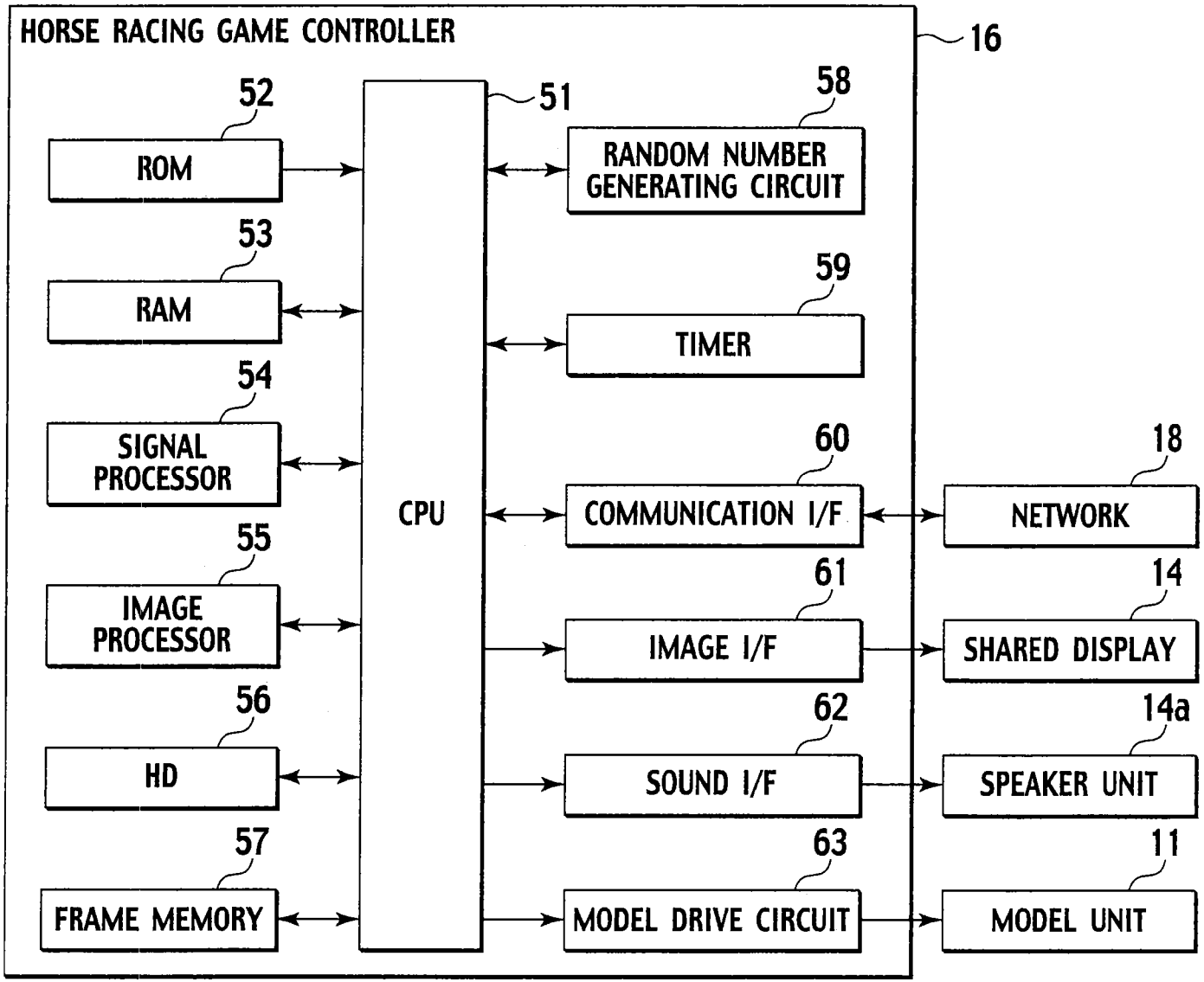
FIG. 6 is a block diagram showing a configuration of a horse racing game controller in the gaming machine according to the first embodiment of the present invention.

Next, description will be given of configurations of the respective game controllers provided in the host server 15. FIG. 6 is a block diagram showing an internal configuration of the horse racing game controller 16 provided in the host server 15. As shown in FIG. 6, the horse racing game controller 16 includes: a CPU 51 for performing overall control; a ROM 52 for storing system programs; and a RAM 53 for temporarily storing data.

Moreover, the horse racing game controller 16 also includes: a signal processor 54 which generates data on position coordinates of the respective racehorses in a world coordinate system at each moment from start to end of the race in the horse racing game; an image processor 55 which generates three-dimensional object data for displaying on the screen a three-dimensional image of each of the racehorses in the horse racing game; a hard disk 56 which stores various data related to modeling and textures required for generation of the three-dimensional object data; and a frame memory 57 into which frame data on images to be displayed on the shared display 14 is written.

Furthermore, the horse racing game controller 16 further includes: a random number generating circuit 58 which generates various random numbers related to execution of the horse racing game; a timer 59 for managing various times required for the horse racing game to proceed; a communication I/F 60 for communicating with the relay controller 19 through the network 18; an image I/F 61 for outputting display data to the shared display 14; a sound I/F 62 for outputting a sound signal to the speaker units 14*a* of the shared display 14; and a model drive circuit 63 for allowing the racehorses 12, 12, . . . to run on the course 13 in the model unit 11.

Figure 7:
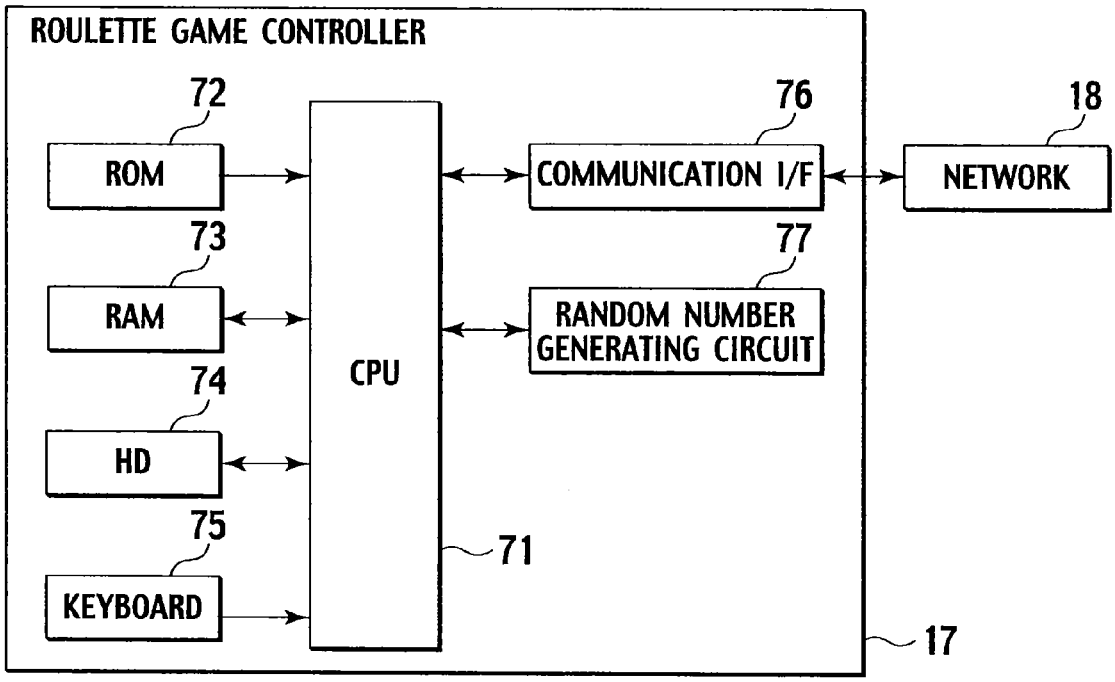
FIG. 7 is a block diagram showing a configuration of a roulette game controller in the gaming machine according to the first embodiment of the present invention.

FIG. 7 is a block diagram showing a configuration of the roulette game controller 17. The roulette game controller 17 controls the roulette game to be executed on the individual display 24 in each of the gaming terminals 20. As shown in FIG. 7, the roulette game controller 17 includes: a CPU 71 for performing overall control of the game; a ROM 72; a RAM 73; a hard disk 74 which stores various data required for execution of the roulette game; a keyboard 75 for receiving an operation input from a manager; a communication I/F 76 for communicating with the relay controller 19 through the network 18; and a random number generating circuit 77 which generates various random numbers related to execution of the roulette game.

The roulette game controller 17 receives a bet made on the bet reception screen displayed on the individual display 24 in each of the gaming terminals 20 until the reception deadline comes. Moreover, the roulette game controller 17 allows the individual display 24 to display a roulette game execution screen by use of data to be outputted to each of the gaming terminals 20 through the network 18 and the relay controller 19. Furthermore, the roulette game controller 17 allows a payout corresponding to an outcome of the executed roulette game to be provided at each of the gaming terminals 20.

Figure 8:
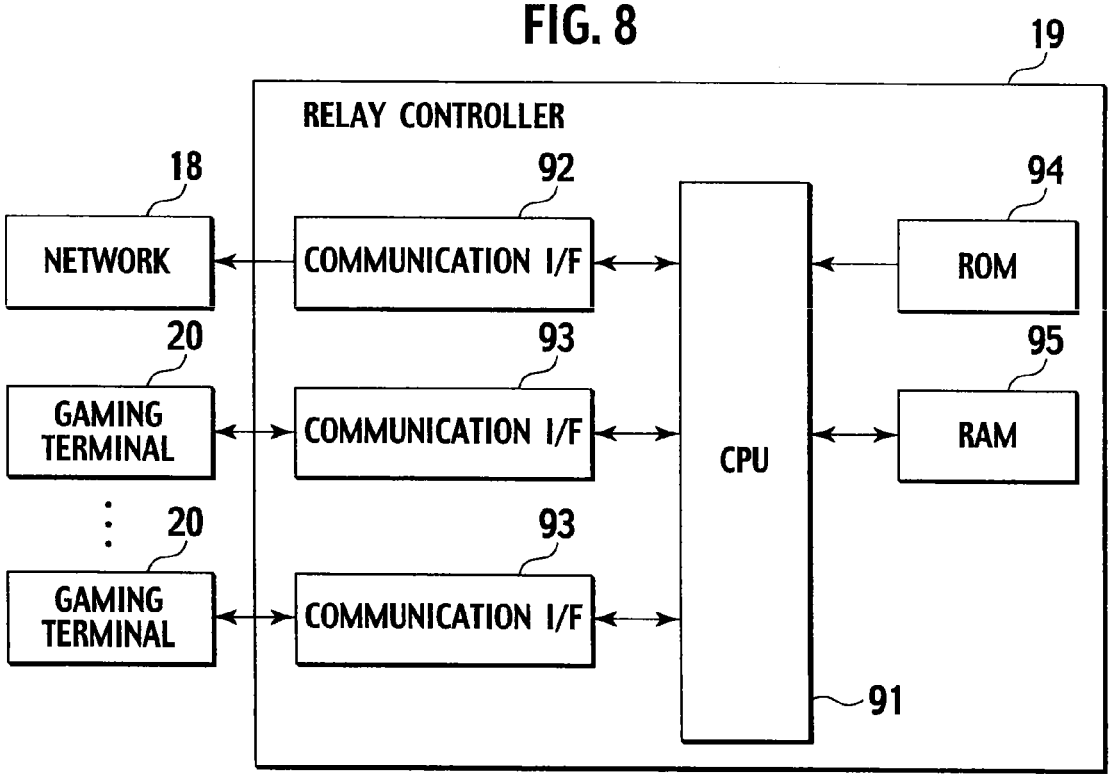
FIG. 8 is a block diagram showing a configuration of a relay controller in the gaming machine according to the first embodiment of the present invention.

Next, a configuration of the relay controller 19 will be described. FIG. 8 is a block diagram showing the configuration of the relay controller 19. The relay controller 19 includes: a CPU 91 for performing overall control; a communication I/F 92 for communicating with the host server 15 through the network 18; communication I/Fs 93 for communicating with the respective gaming terminals 20; a ROM 94; and a RAM 95.

The CPU 91 outputs data from the horse racing game controller 16 or the roulette game controller 17 by sorting the data to the corresponding gaming terminals 20. Moreover, the CPU 91 performs processing of outputting data from each of the gaming terminals 20 to the corresponding horse racing game controller 16 or roulette game controller 17 after adding, to the data, information such as a header indicating a source of the data.

Figure 9:
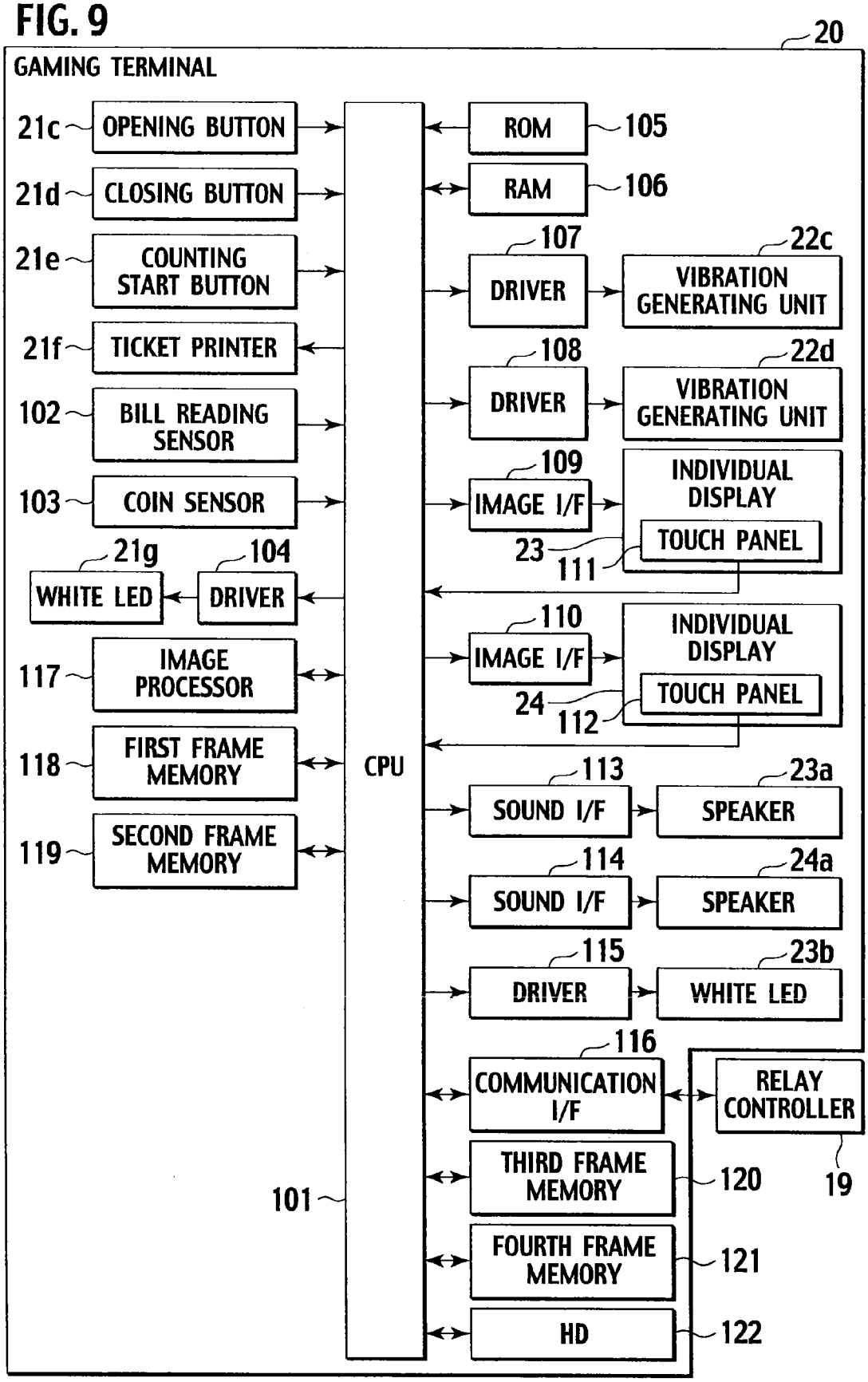
FIG. 9 is a block diagram showing a configuration of the gaming terminal in the gaming machine according to the first embodiment of the present invention.

FIG. 9 is a block diagram showing an internal configuration of the gaming terminal 20 according to this embodiment. Note that the respective gaming terminals 20 have basically the same configuration. Thus, one of the gaming terminals 20 will be described below as a representative thereof.

As shown in FIG. 9, the gaming terminal 20 includes a CPU 101, a ROM 105 and a RAM 106. The ROM 105 is formed of, for example, a semiconductor memory or the like, and stores a program for performing basic functions of the gaming terminal 20, various other programs required for control of the gaming terminal 20, a data table and the like. Moreover, the RAM 106 is a memory for temporarily storing various data processed by the CPU 101, the number of credits (accumulated in the gaming terminal 20) which are currently owned by the player, a state of betting coins by the player, and the like.

The following components are connected to the CPU 101: the buttons 21*c* and 21*d* for opening and closing the coin insertion slot 21*b* in the box unit 21; the counting start button 21*e*; the ticket printer 21*f*; a bill reading sensor 102 for reading a bill inserted from the bill insertion slot 21*a*; a coin sensor 103 for detecting coins inserted into the coin insertion slot 21*b*; and a driver 104 for the plurality of white LEDs 21*g*.

Moreover, the following components are also connected to the CPU 101: drivers 107 and 108 for allowing the vibration generating units 22*c* and 22*d* installed respectively in the sitting part 22*a* and the backrest part 22*b* of the seat 22 to generate vibration; image I/Fs 109 and 110 for outputting display data to the individual displays 23 and 24; touch panels 111 and 112 which are provided on the individual displays 23 and 24, receive touch operations performed by the player and output inputted signals to the CPU 101; sound I/Fs 113 and 114 for outputting sound signals to the speakers 23*a* and 24*a* of the individual displays 23 and 24; a driver 115 for the plurality of white LEDs 23*b* of the individual display 23; and a communication I/F 116 for communicating with the relay controller 19.

Furthermore, the following components are further connected to the CPU 101: an image processor 117 which generates three-dimensional object data on each of the racehorses in the horse racing game; a first frame memory 118 for storing frame data on race images of the horse racing game to be displayed on the individual display 23; a second frame memory 119 for storing frame data on an effect image to be synthesized with and superimposed on the frame data written into the first frame memory 118; a third frame memory 120 for synthesizing the frame data written respectively into the first and second frame memories 118 and 119; a fourth frame memory 121 for storing frame data on images to be displayed on the individual display 24; and a hard disk 122 into and from which various data is written and read.

Based on an operation signal outputted by pressing each of the buttons 21*c*, 21*d*, 21*e* and 21*f*, or the like, the CPU 101 performs control for executing various operations corresponding thereto. To be more specific, in response to input of an operation by the player, the CPU 101 executes various kinds of processing based on input signals supplied from the respective buttons 21*c*, 21*d*, 21*e* and 21*f* and the data and programs stored in the ROM 105 and the RAM 106. Thereafter, the CPU 101 transmits results of the processing to the host server 15 through the relay controller 19 and the network 18.

The coin sensor 103 detects the coins inserted from the coin insertion slot 21*b*, counts the number of the inserted coins, and outputs counting result data to the CPU 101. Based on the counting result data, the CPU 101 increases the number of credits owned by the player, and stored in the RAM 106.

Next, description will be given of operations of the gaming machine 10 according to this embodiment having the configuration described above.

Figure 10:
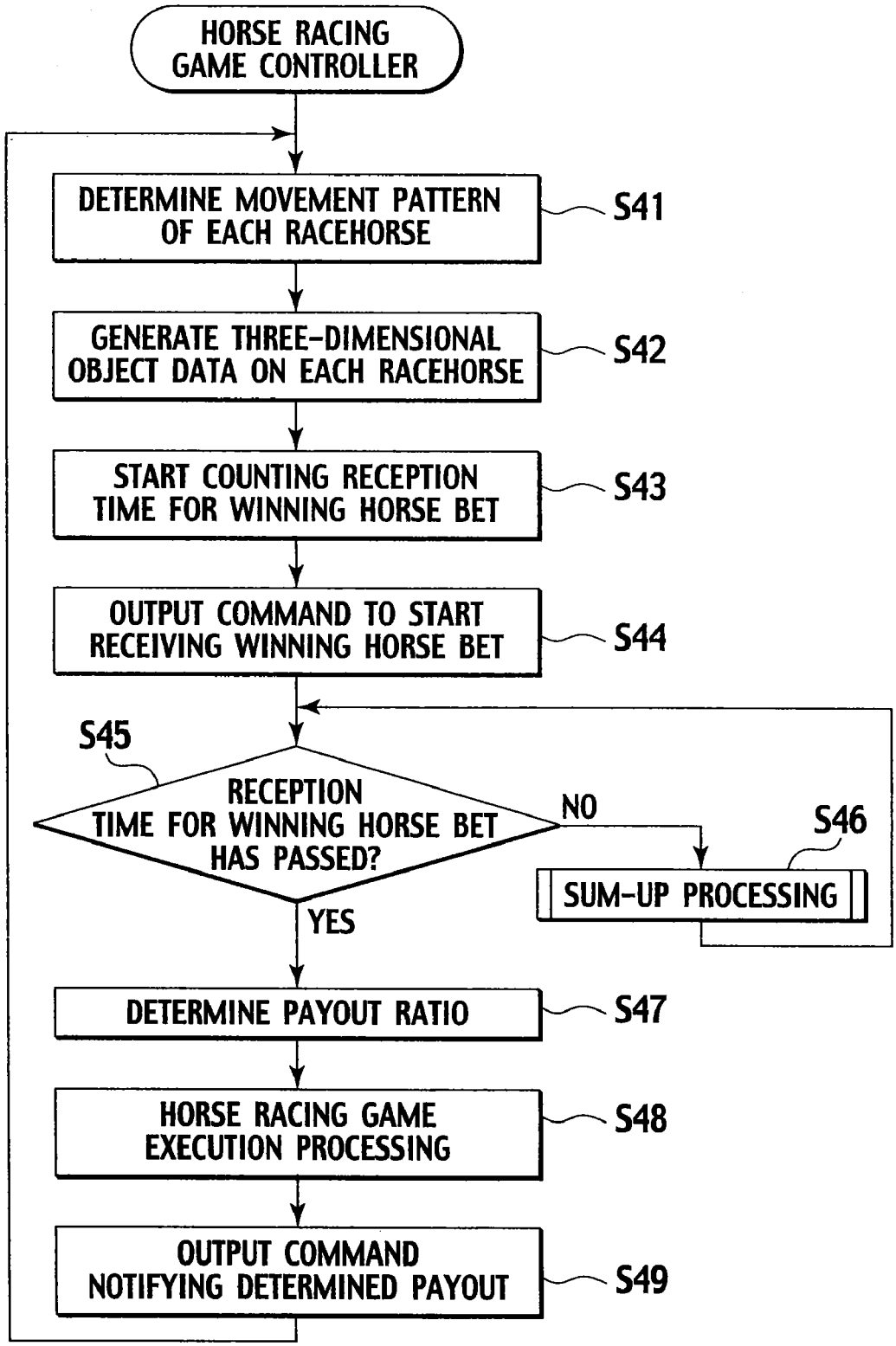
FIG. 10 is a flowchart showing procedures executed by the horse racing game controller in the gaming machine according to the first embodiment of the present invention.

FIG. 10 is a flowchart showing procedures executed by the horse racing game controller 16 in the host server 15. As shown in FIG. 10, when the gaming machine 10 according to this embodiment starts operations thereof, the CPU 51 of the horse racing game controller 16 first uses the signal processor 54 to determine a movement pattern of each of the racehorses 12 in a horse racing game to be executed next on the model unit 11 (Step S41). This movement pattern includes the data on the position coordinates of each of the racehorses 12 in the world coordinate system at each moment from start to end of the race. Therefore, a running pace of each of the racehorses 12, an order of arrival thereof and the like in the next race are defined by the movement pattern.

After determining the movement pattern of each of the racehorses 12 in the next horse racing game by use of the signal processor 54, the CPU 51 next uses the image processor 55 to generate three-dimensional object data for displaying on the screen three-dimensional images of the racehorses 12 (Step S42). This generation of the three-dimensional object data involves: modeling of the racehorses 12 by use of polygons; applying textures to the respective polygons; and assignment of coordinates of a representative point of each of the modeled racehorses 12 to the position coordinates in the world coordinate system at each moment from the start to end of the race, the position coordinates being determined in Step S41.

After generating the three-dimensional object data on the racehorses 12 by use of the image processor 55, the CPU 51 next starts counting winning horse bet reception time with the timer 59 (Step S43). Thereafter, the CPU 51 generates a command notifying each of the gaming terminals 20 of the start of winning horse bet reception and outputs the command to the relay controller 19 through the network 18 (Step S44).

Subsequently, the CPU 51 executes sum-up processing (Step S46) until it is determined in Step S45 that the winning horse bet reception time counted by the timer 59 has passed.

Figure 11:
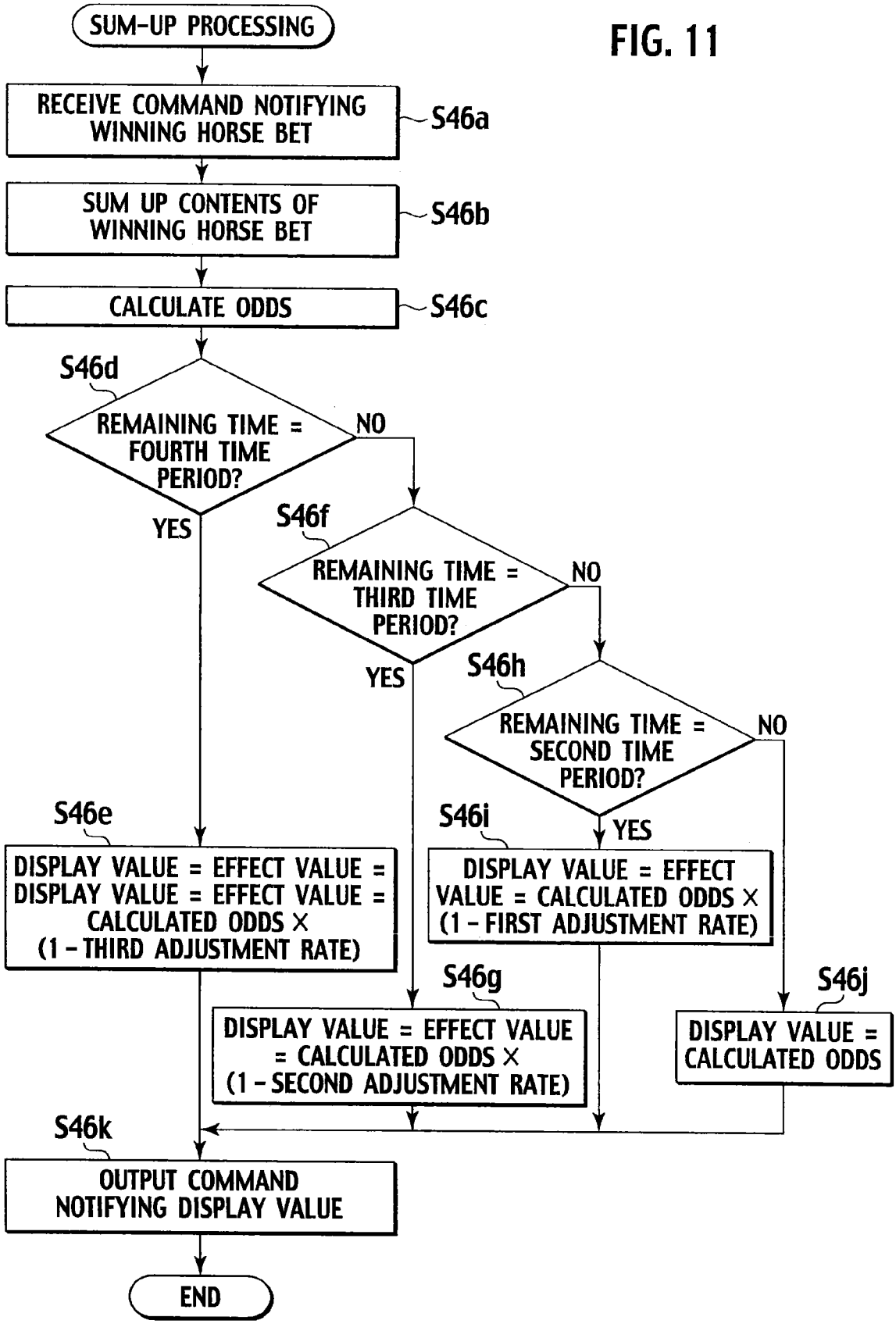
FIG. 11 is a flowchart showing a subroutine of sum-up processing shown in FIG. 10.

FIG. 11 is a flowchart showing a subroutine of the sum-up processing in Step S46 shown in FIG. 10. In the sum-up processing, the CPU 51 receives from the relay controller 19 a command notifying the winning horse on which the bet is made at each of the gaming terminals 20 (Step S46*a*), sums up contents of the bet on the winning horse notified by the command received (Step S46*b*) and calculates the latest odds by use of the sum-up result (S46*c*).

Thereafter, the CPU 51 determines whether or not remaining time up to the end of the winning horse bet reception time (bet reception deadline) belongs to the fourth time period of over 3 minutes (Step S46*d*). If the remaining time does not belong to the fourth time period (NO in Step S46*d*), the CPU 51 moves on to Step S46*f* to be described later. On the other hand, if the remaining time belongs to the fourth time period (YES in Step S46*d*), the CPU 51 determines an effect value obtained by reducing the latest value of the odds calculated in Step S46*c* by a third adjustment rate (for example, 30%) as a display value of the odds (Step S46*e*) and moves on to Step S46*k* to be described later.

In Step S46*f*, the CPU 51 determines whether or not the remaining time up to the end of the winning horse bet reception time (bet reception deadline) belongs to the third time period of 1 minute and 30 seconds to 3 minutes. If the remaining time does not belong to the third time period (NO in Step S461), the CPU 51 moves on to Step S46*h* to be described later. On the other hand, if the remaining time belongs to the third time period (YES in Step S46*f*), the CPU 51 determines an effect value obtained by reducing the latest value of the odds calculated in Step S46*c* by a second adjustment rate (for example, 20%) as the display value of the odds (Step S46*g*) and moves on to Step S46*k*.

In Step S46*h*, the CPU 51 determines whether or not the remaining time up to the end of the winning horse bet reception time (bet reception deadline) belongs to the second time period of 30 seconds to 1 minute and 30 seconds. If the remaining time belongs to the second time period (YES in Step S46*h*), the CPU 51 determines an effect value obtained by reducing the value of the odds calculated in Step S46*c* by a first adjustment rate (for example, 10%) as the display value of the odds (Step S46*i*) and moves on to Step S46*k*. On the other hand, if the remaining time does not belong to the second time period (NO in Step S46*h*), the CPU 51 determines the latest value of the odds calculated in Step S46*c* as the display value as it is (Step S46*j*) and moves on to Step S46*k*.

In Step S46*k*, the CPU 51 generates a command notifying each of the gaming terminals 20 of the determined display value of the odds and outputs the command to the relay controller 19 through the network 18. After the command notifying each of the gaming terminals 20 of the display value of the odds is outputted, the CPU 51 terminates the sum-up processing and returns to Step S45 in FIG. 10.

If it is determined in Step S45 in FIG. 10 that the winning horse bet reception time has passed (YES in Step S45), the CPU 51 determines a payout ratio by summing up the contents of the winning horse bets received (Step S47) and then performs horse racing game execution processing based on the movement patterns of the racehorses 12, which are determined in Step S41 (Step S48).

In the horse racing game execution processing of Step S48, the horse racing game controller 16 uses the model drive circuit 63 to allow the racehorses 12 to run on the course 13 in the model unit 11 and to cross the finish line according to the movement patterns of the racehorses 12, which are determined in Step S41. Moreover, a screen showing the race is displayed on the shared display 14 or the individual display 23 in each of the gaming terminals 20.

After the horse racing game execution processing is finished, the CPU 51 determines a payout to the player at each of the gaming terminals 20, the payout corresponding to the order of arrival determined in Step S41 in the finished horse racing game. Thereafter, the CPU 51 generates a command notifying each of the gaming terminals 20 of the determined payout and outputs the command to the relay controller 19 through the network 18 (Step S49). After the command notifying each of the gaming terminals 20 of the determined payout is outputted, the CPU 51 returns to Step S41.

Figure 12:
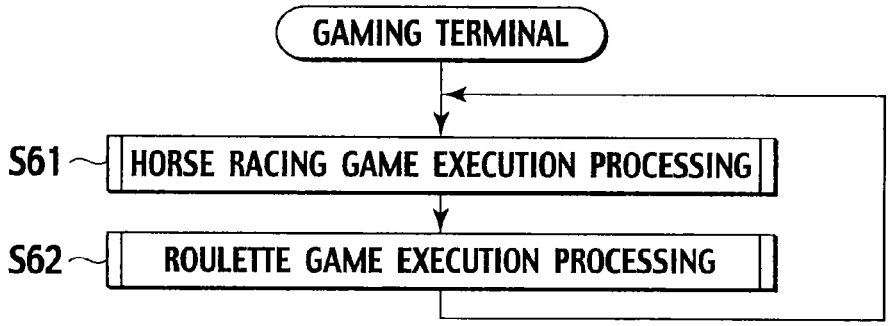
FIG. 12 is a flowchart showing procedures executed by the gaming terminal in the gaming machine according to the first embodiment of the present invention.

FIG. 12 is a flowchart showing processes executed by each of the gaming terminals 20. As shown in FIG. 12, when the gaming machine 10 according to this embodiment starts operations thereof, the CPU 101 of each of the gaming terminals 20 repeatedly executes horse racing game execution processing (Step S61) and roulette game execution processing (Step S62).

Figure 13:
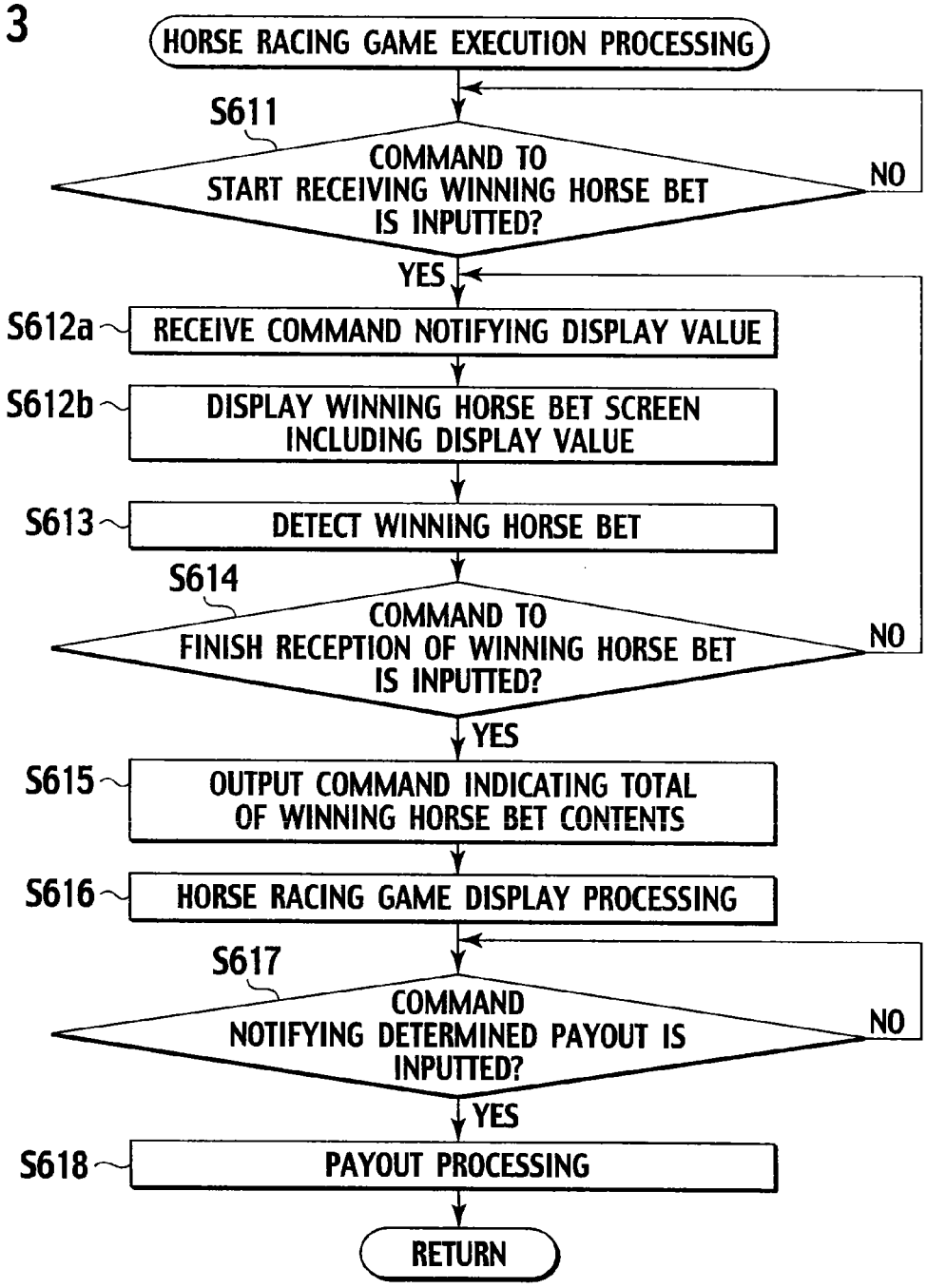
FIG. 13 is a flowchart showing a subroutine of horse racing game execution processing shown in FIG. 12.

FIG. 13 is a flowchart showing a subroutine of the horse racing game execution processing in Step S61 shown in FIG.

12. In the horse racing game execution processing, first, the CPU 101 of the gaming terminal 20 waits for a command from the horse racing game controller 16 in the host server 15 to be inputted from the relay controller 19, the command notifying start of winning horse bet reception in a horse racing game (Step S611).

When the command notifying the start of winning horse bet reception is inputted from the relay controller 19, the CPU 101 repeatedly and periodically executes reception of a command notifying a display value of odds (Step S612*a*), display of the bet reception screen 231 shown in FIG. 14 for making a winning horse bet in the horse racing game on the individual display 23, the screen showing the display value notified by the received command as the odds (Step S612*b*) and detection of presence and contents of the winning horse bet by detecting an operation on the touch panel 111 (Step S613), until the command notifying end of the winning horse bet reception is inputted from the relay controller 19 in Step S614.

Thereafter, when a command notifying end of the winning horse bet reception is inputted in Step S614, the CPU 101 outputs to the relay controller 19 a command notifying sum-up contents of the winning horse bets detected in Step S613 (Step S615) and executes horse racing game display processing (Step S616). In this horse racing game display processing, processing of displaying race images on the individual display 23 based on the data from the horse racing game controller 16 in the host server 15, and the like are executed.

After the horse racing game display processing is finished, the CPU 101 waits for a command from the horse racing game controller 16 in the host server 15 to be inputted from the relay controller 19, the command notifying the determined payout (Step S617). When the command notifying the determined payout is inputted from the relay controller 19, the CPU 101 performs payout processing corresponding to the determined payout notified (Step S618). In this payout processing, processing such as updating the number of credits displayed in a credit display part 239 on the bet reception screen 231 shown in FIG. 14 for the horse racing game, the screen being displayed on the individual display 23, is performed based on the payout result. Thereafter, the horse racing game execution processing is finished.

Moreover, in the roulette game execution processing in Step S62, the CPU 101 receives bets made by operating the touch panel 112 on the individual display 24 during bet reception time for a roulette game, and outputs the contents received to the relay controller 19. Moreover, after the bet reception time has passed, the CPU 101 displays a roulette game execution screen on the individual display 24 based on data from the roulette game controller 17 in the host server 15. After the roulette game is finished, the CPU 101 allows the individual display 24 to display the contents of the determined payout for the finished roulette game based on the data from the roulette game controller 17.

As described above, in the gaming machine according to this embodiment, the effect value smaller than the actual odds is displayed as the latest value of the odds on the individual display 23 in each of the gaming terminals 20 until the remaining time to the end of the winning horse bet reception for the horse racing game is reduced to 30 seconds. Therefore, even if the value of the actual odds is significantly changed (reduced in many cases) by addition of winning horse bets, a range of change in the effect value displayed as the odds on the individual display 23 is relatively small.

Thus, for example, even if a large amount of bets are made like last-minute bets almost concurrently just before the deadline for betting, the effect value displayed as the odds on the individual display 23 is prevented from being changed as significantly as the actual odds. Accordingly, the player is prevented from losing motivation for the horse racing game due to the change in the odds after the winning horse bet. Thus, entertainment properties of the horse racing game can be improved.

Moreover, in the gaming machine according to this embodiment, a rate of reduction in the effect value with respect to the actual odds is lowered from the third adjustment rate (for example, 30%) to the second adjustment rate (for example, 20%) and then to the first adjustment rate (for example, 10%) as the remaining time to the end of the winning horse bet reception approaches 30 seconds. Thus, the effect value to be displayed as the latest value of the odds on the individual display 23 increases, gradually approaching the actual value of the odds unless the effect value is changed by the increase in the winning horse bets.

Thus, a sudden drop in the odds displayed on the individual display 23 is prevented even near the bet reception deadline at which the last-minute bets are increased. Accordingly, a player, who has already made a bet on a winning horse by watching the odds displayed on the individual display 23, is more likely to keep his/her expectations for the previously-watched odds until immediately before the start of the race.

Note that, in the first embodiment described above, the horse racing game controller 16 in the host server 15 and the CPU 101 of the gaming terminal 20 correspond to the controller in the claims.

In the first embodiment described above, the odds are displayed on the individual display 23 in each of the gaming terminals 20. However, the gaming machine can also be configured so as to allow the odds to be displayed on the shared display 14. A gaming machine thus configured according to the second embodiment of the present invention will be described below.

The gaming machine according to the second embodiment of the present invention is for playing a horse racing game as in the case of the gaming machine according to the first embodiment. In the gaming machine according to the second embodiment of the present invention, some of the contents of the sum-up processing performed in Step S46 shown in FIG. 10 by the horse racing game controller 16 in the host server 15 in the gaming machine according to the first embodiment are slightly different from those of the subroutine shown in FIG. 11.

Moreover, in the gaming machine according to the second embodiment of the present invention, some of the contents of the horse racing game execution processing performed in Step S61 shown in FIG. 12 by the CPU 101 in each of the gaming terminals 20 in the gaming machine according to the first embodiment are slightly different from those of the subroutine shown in FIG. 13.

Figure 15:
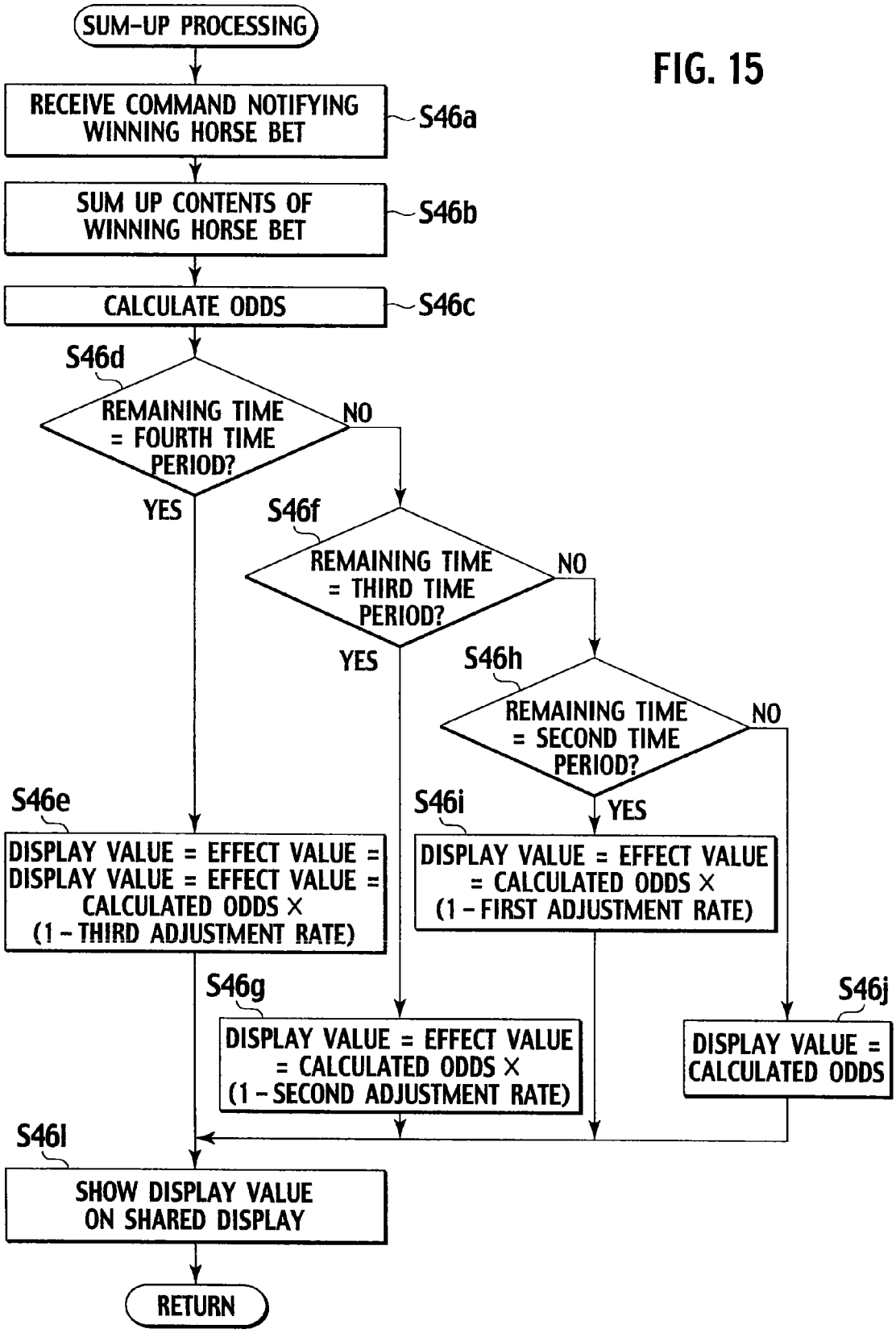
FIG. 15 is a flowchart showing a subroutine of sum-up processing among procedures executed by a horse racing game controller in a gaming machine according to the second embodiment of the present invention.

FIG. 15 is a flowchart showing a subroutine of sum-up processing performed by a CPU 51 of a horse racing game controller 16 in the gaming machine according to the second embodiment of the present invention. In the sum-up processing, the CPU 51 of the horse racing game controller 16 executes processes in Steps S46*a* to S46*j*, which are the same as those performed by the CPU 51 of the horse racing game controller 16 in the gaming machine according to the first embodiment, except the process in Step S46*k* shown in FIG. 11.

Thereafter, the CPU 51 of the horse racing game controller 16 in the second embodiment displays a determined display value of odds on a shared display 14 (Step S461) as shown in FIG. 15, instead of the process in Step S46*k* shown in FIG. 11, which is performed by the CPU 51 of the horse racing game controller 16 in the first embodiment. When the display value of the odds is displayed on the shared display 14, the CPU 51 terminates the sum-up processing and returns to Step S45 in FIG. 10.

Figure 16:
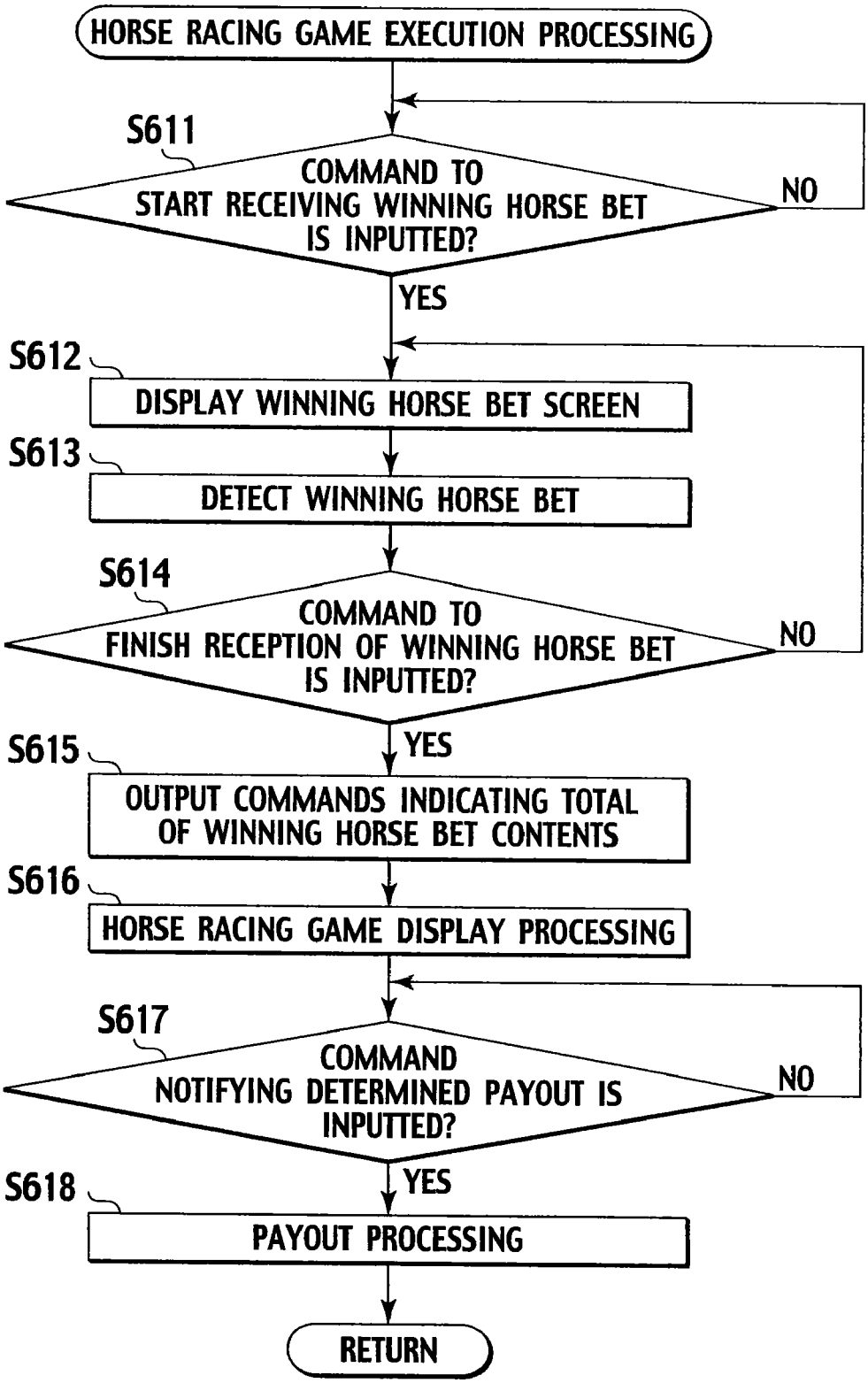
FIG. 16 is a flowchart showing a subroutine of horse racing game execution processing among procedures executed by a gaming terminal in the gaming machine according to the second embodiment of the present invention.

FIG. 16 is a flowchart showing a subroutine of horse racing game execution processing performed by a CPU 101 of each of gaming terminals 20 in the gaming machine according to the second embodiment of the present invention. In the horse racing game execution processing, as shown in FIG. 16, the CPU 101 of each of the gaming terminals 20 displays on the individual display 23 the bet reception screen 231 shown in FIG. 14 for making a winning horse bet in the horse racing game (Step S612), instead of the processes in Steps S612*a* and S612*b* in the horse racing game execution processing shown in FIG. 13, which is performed by the CPU 101 of each of the gaming terminals 20 in the gaming machine according to the first embodiment.

As described above, the gaming machine according to this embodiment can achieve the same effects as those achieved by the gaming machine according to the first embodiment, except for the point that the odds are displayed on the shared display 14 instead of the individual display 23 in each of the gaming terminals 20.

Note that, in the second embodiment described above, the horse racing game controller 16 in the host server 15 corresponds to the controller in the claims.

In the first and second embodiments described above, the odds are displayed on one of the individual display 23 in each of the gaming terminals 20 and the shared display 14. However, the gaming machine can also be configured so as to display the odds on both of the individual display 23 in the gaming terminal 20 and the shared display 14. A gaming machine thus configured according to the third embodiment of the present invention will be described below.

The gaming machine according to the third embodiment of the present invention is for playing a horse racing game as in the case of the gaming machines according to the first and second embodiments. In the gaming machine according to the third embodiment, some of the contents of the sum-up processing performed in Step S46 shown in FIG. 10 by the horse racing game controller 16 in the host server 15 in the gaming machine according to the first embodiment are slightly different from those of the subroutine shown in FIG. 11.

Figure 17:
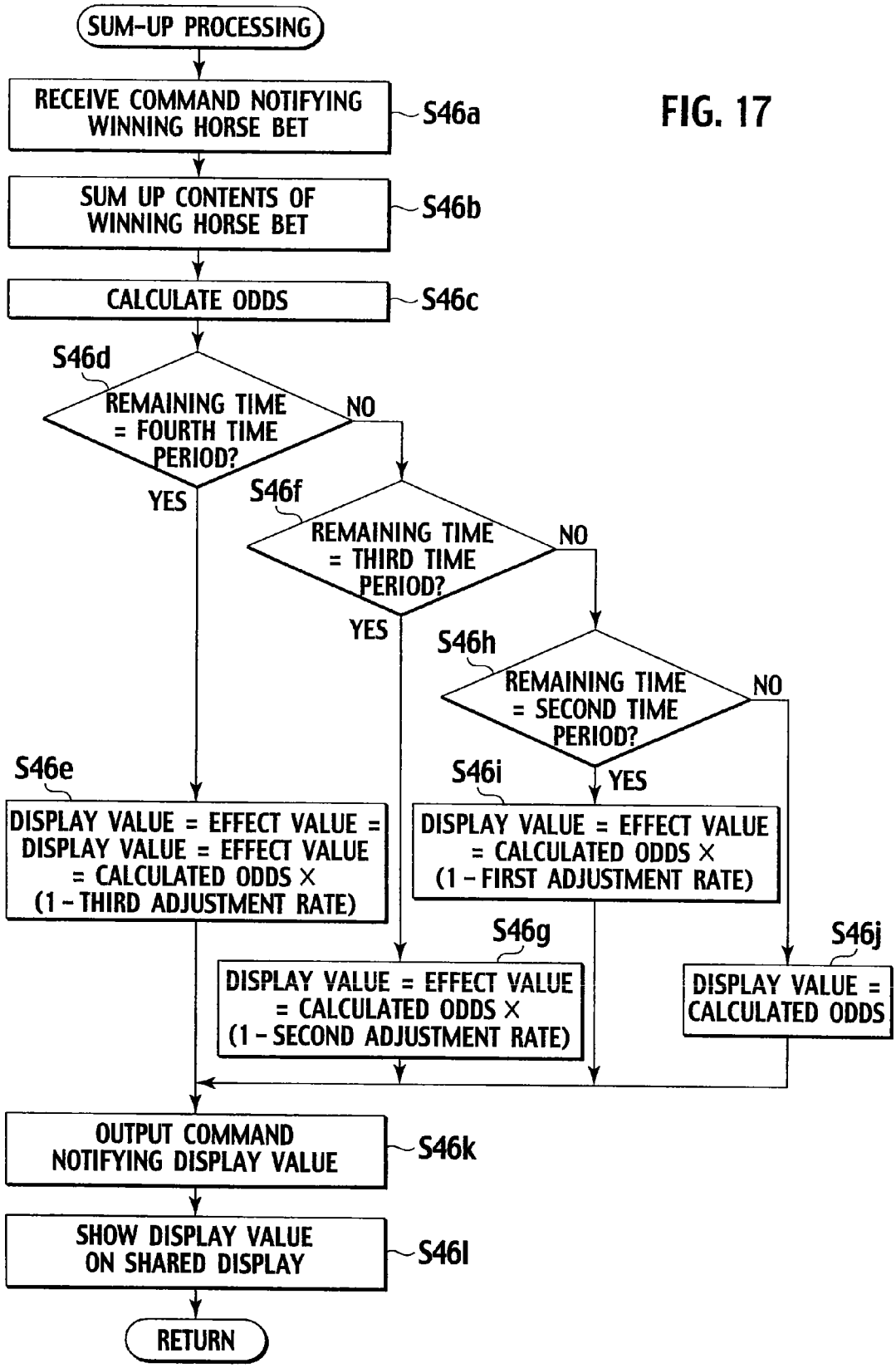
FIG. 17 is a flowchart showing a subroutine of sum-up processing among procedures executed by a horse racing game controller in a gaming machine according to the third embodiment of the present invention.

FIG. 17 is a flowchart showing a subroutine of sum-up processing performed by a CPU 51 of a horse racing game controller 16 in the gaming machine according to the third embodiment of the present invention. In the sum-up processing, the CPU 51 of the horse racing game controller 16 executes processes in Steps S46*a* to S46*k*, which are the same as those performed by the CPU 51 of the horse racing game controller 16 in the gaming machine according to the first embodiment, except the process in Step S46*k* shown in FIG. 11.

Thereafter, the CPU 51 of the horse racing game controller 16 in the third embodiment displays a determined display value of odds on a shared display 14 (Step S461) as shown in FIG. 17 subsequent to the process in Step S46*k* shown in FIG. 11, which is performed by the CPU 51 of the horse racing game controller 16 in the first embodiment. When the display value of the odds is displayed on the shared display 14, the CPU 51 terminates the sum-up processing and returns to Step S45 in FIG. 10.

As described above, the gaming machine according to this embodiment can achieve the same effects as those achieved by the gaming machine according to the first embodiment, except that the odds are displayed on both of the individual display 23 in each of the gaming terminals 20 and the shared display 14.

Note that, in the third embodiment described above, the horse racing game controller 16 in the host server 15 and the CPU 101 of the gaming terminal 20 correspond to the controller in the claims.

Although the gaming machine according to the embodiments of the present invention has been described above, the concrete examples are merely illustrated and are not intended to particularly limit the present invention. The specific configurations of the respective means and the like can be appropriately changed in design. Moreover, the effects described in the embodiments of the present invention are only a list of optimum effects achieved by the present invention. Therefore, the effects of the present invention are not limited to those described in the embodiments of the present invention.

Figure 18:
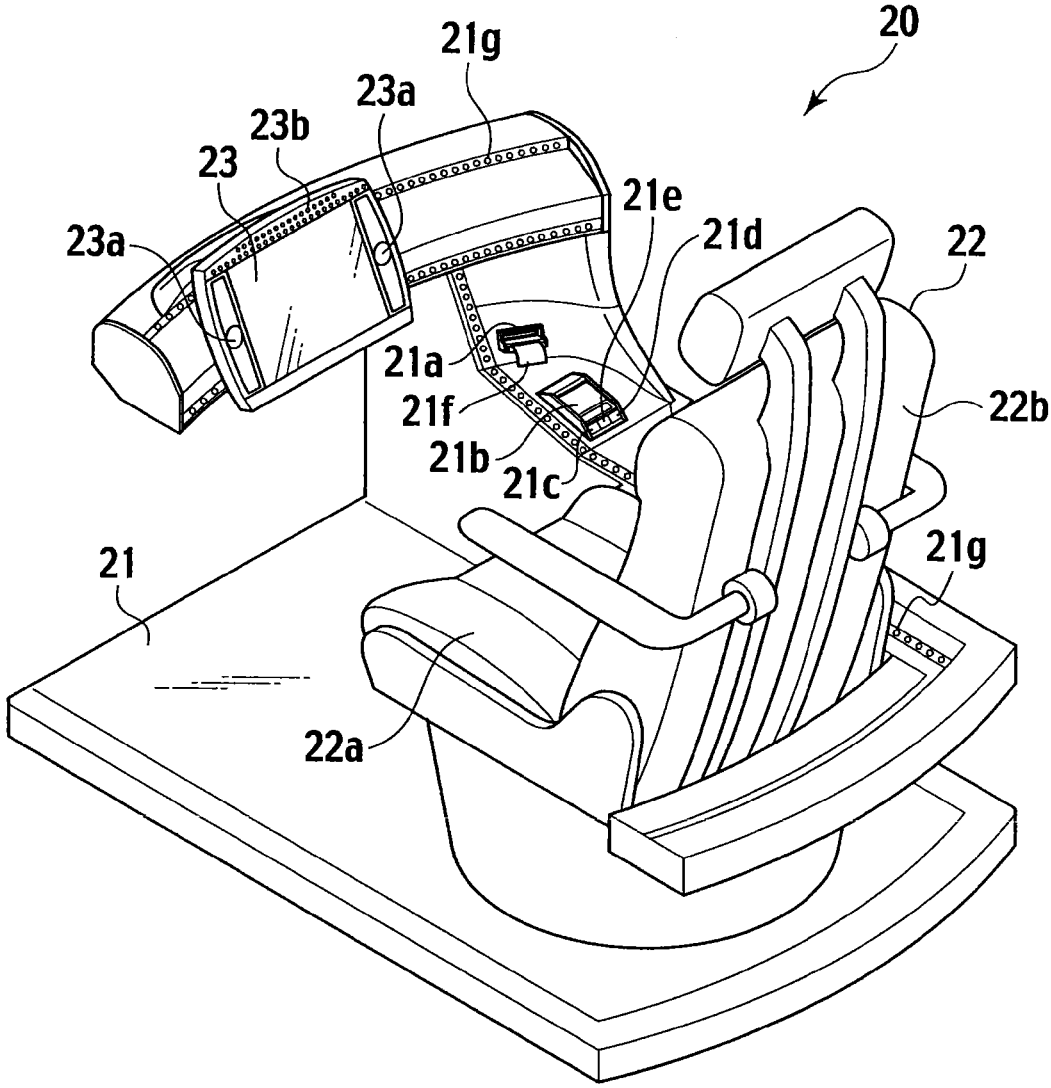
FIG. 18 is an external view of a gaming terminal of a gaming machine according to a modified example of the first to third embodiments of the present invention.

For example, in the gaming machine according to the first to third embodiments described above, the description was given of the case where the horse racing game and the roulette game are concurrently played and those games are individually displayed on the two individual displays 23 and 24 in each of the gaming terminals 20. However, the present invention can also be applied to the case where the horse racing game is solely performed and is displayed on the single individual display 23 in each of the gaming terminals 20 as shown in FIG. 18.

Moreover, in the gaming machine according to the first to third embodiments described above, the description was given of the gaming machine for playing the horse racing game as an example of the racing game. However, the present invention can also be applied to, for example, a gaming machine for playing a boat racing game by using race boats as characters, a gaming machine for playing a car race by using racing cars as characters, or a gaming machine for playing a racing game such as a track event by using athletes such as track and field athletes as characters.

Figure 19:
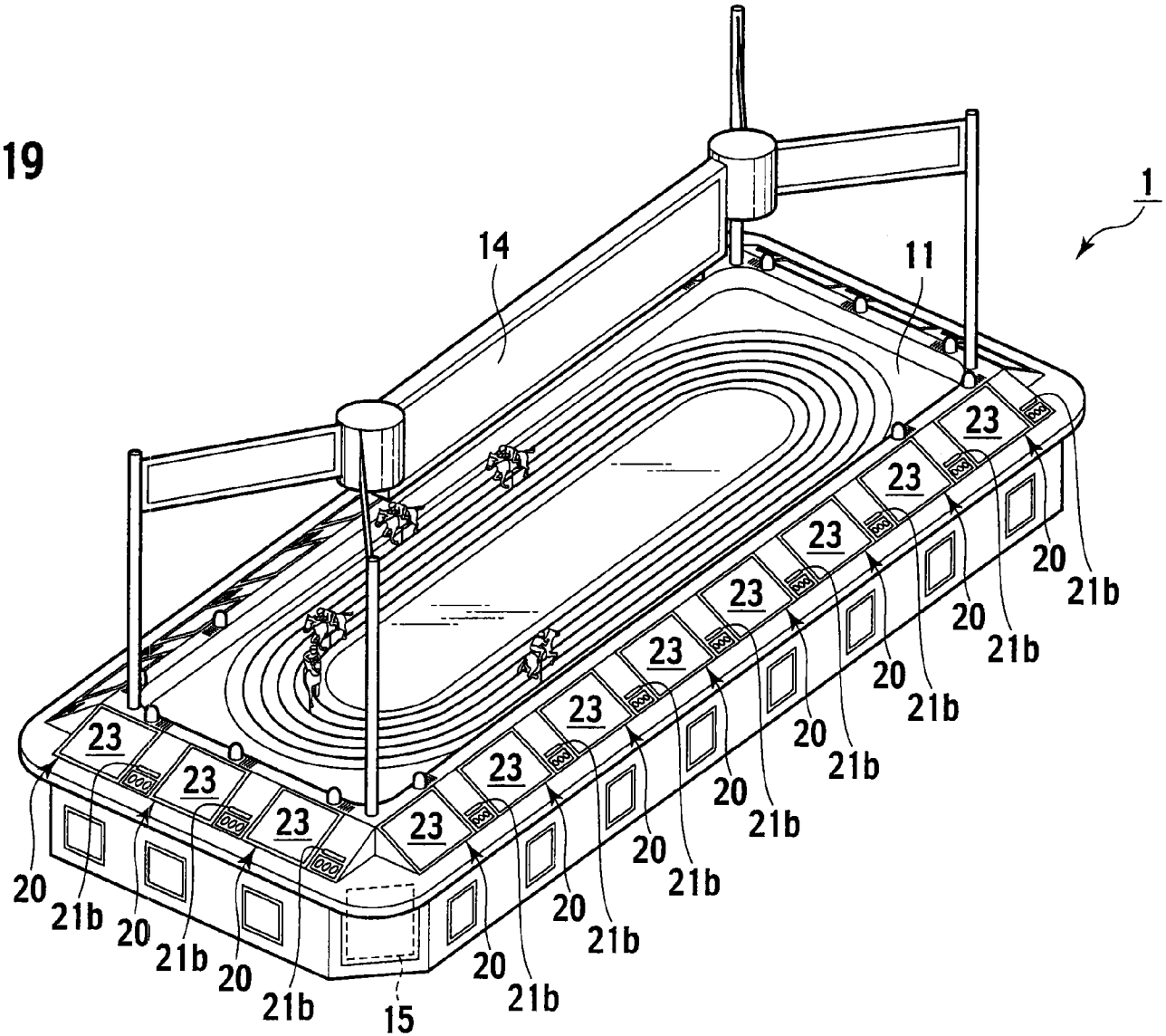
FIG. 19 is an external view of a gaming machine according to another modified example of the first to third embodiments of the present invention.

Furthermore, in the first to third embodiments described above, the description was given of the gaming machine having the chair-type configuration with the independent gaming terminals 20. However, the present invention can also be applied to a gaming machine having a configuration in which a plurality of slant-type gaming terminals 20 are arranged around a model unit 11 as shown in FIG. 19, for example.

In addition, in the detailed description above, the characteristic portions are mainly described in order to make the present invention easily understandable. The present invention is not limited to the embodiments described in the detailed description above, and can be applied to the other embodiments, and its range of application is wide. Also, the terms and the terminology used in the present specification are used only for the purpose of explaining the present invention precisely, and not used for the purpose of limiting the interpretation of the present invention. Also, for those skilled in the art, it should be easy to contemplate other configurations, systems, methods, etc., that are contained in the concept of the present invention, from the content of the invention described in the present specification. Consequently, the description of the scope of claims should be construed as containing equivalent configurations within a range of not deviating from a range of the technical ideas of the present invention. Also, the purpose of the abstract is to make it possible for the patent office, the general public organizations, and technicians and the like who belong to the present technical field and who are not thoroughly familiar with patent and law terms or specialized terms, to quickly judge the technical content and its essence of the present application by a simple search. Consequently, the abstract is not intended to limit the scope of the invention which should be evaluated by the description of the scope of claims. Also, in order to sufficiently understand the purpose of the present invention and the effects specific to the present invention, they should preferably be interpreted by sufficiently referring to the documents and the like that are already disclosed in public.

Also, the detailed description above contains the processing to be executed by a computer. The explanations and expressions in the above are described for the purpose of facilitating the most efficient understanding by those skilled in the art. In the present specification, each step used in deriving one result should be understood as a processing without a self-contradiction. Also, at each step, transmission and reception, recording, etc., of electric or magnetic signals will be carried out. In the processing at each step, such signals are expressed by bits, values, symbols, letters, terms, numbers, etc., but it should be noted that they are used simply because they are convenient for the purpose of explanation. Also, there are cases where the processing at each step is described by an expression common to the human behavior, but the processing described in the present specification is to be executed by various devices in principle. Also, the other configuration required in carrying out each step will be obvious from the above description.

What is claimed is:

1. A gaming machine comprising:

a display adapted to display a racing game in which a plurality of characters race against each other;

a gaming terminal configured to receive a bet made by a player regarding an order of arrival of the plurality of characters in the racing game; and a controller configured to (a) periodically sum up bets made by players and received by the gaming terminal, (b) periodically calculate a latest value of odds for the racing game on the basis of a latest sum-up result of the bets, and (c) display on the display the odds for the racing game as an effect value smaller than the latest value by a predetermined rate in a time period with more than predetermined time left to a deadline for the bets.

2. The gaming machine according to claim 1, wherein the controller is configured to gradually change the predetermined rate to a smaller value as time approaches a point with the predetermined time left to the deadline for the bets in the time period.

3. The gaming machine according to claim 1, wherein the controller is configured to gradually change a value of the predetermined rate so as to allow the effect value to approach the latest value as time approaches a point with the predetermined time left to the deadline for the bets in the time period.

4. A gaming machine comprising:

a shared display device adapted to display a racing game in which a plurality of characters race against each other;

a gaming terminal configured to receive a bet made by a player regarding an order of arrival of the plurality of characters in the racing game; and a controller configured to (a) periodically sum up bets made by players and received by the gaming terminal, (b) periodically calculate a latest value of odds for the racing game on the basis of a latest sum-up result of the bets, and (c) display, on an individual display of the gaming machine, the odds for the racing game as an effect value smaller than the latest value by a predetermined rate in a time period with more than predetermined time left to a deadline for the bets.

5. The gaming machine according to claim 4, wherein the controller is configured to gradually change the predetermined rate to a smaller value as time approaches a point with the predetermined time left to the deadline for the bets in the time period.

6. The gaming machine according to claim 4, wherein the controller is configured to gradually change a value of the predetermined rate so as to allow the effect value to approach the latest value as time approaches a point with the predetermined time left to the deadline for the bets in the time period.

7. A gaming machine comprising:

a shared display device adapted to display a racing game in which a plurality of characters race against each other;

a gaming terminal configured to receive a bet made by a player regarding an order of arrival of the plurality of characters in the racing game; and a controller configured to (a) periodically sum up bets made by players and received by the gaming terminal, (b) periodically calculate a latest value of odds for the racing game on the basis of a latest sum-up result of the bets, and (c) display, on the shared display device and an individual display of the gaming machine, the odds for the racing game as an effect value smaller than the latest value by a predetermined rate in a time period with more than predetermined time left to a deadline for the bets.

8. The gaming machine according to claim 7, wherein the controller is configured to gradually change the predetermined rate to a smaller value as time approaches a point with the predetermined time left to the deadline for the bets in the time period.

9. The gaming machine according to claim 7, wherein the controller is configured to gradually change a value of the predetermined rate so as to allow the effect value to approach the latest value as time approaches a point with the predetermined time left to the deadline for the bets in the time period.

10. A method for playing a gaming machine, the method comprising the steps of:

displaying on a display a racing game in which a plurality of characters race against each other;

receiving, by a gaming terminal, a bet made by a player regarding an order of arrival of the plurality of characters in the racing game;

periodically summing up bets made by players and received by the gaming terminal;

periodically calculating the latest value of odds for the racing game on the basis of a latest sum-up result of the bets;

displaying an effect value of the odds for the racing game on the display; and setting the effect value smaller than the latest value by a predetermined rate in a time period with more than predetermined time left to a deadline for the bets.

11. The method for playing a gaming machine according to claim 10, further comprising the step of:

gradually changing the predetermined rate to a smaller value as time approaches a point with the predetermined time left to the deadline for the bets in the time period.

12. The method for playing a gaming machine according to claim 10, further comprising the step of:

gradually changing a value of the predetermined rate so as to allow the effect value to approach the latest value as time approaches a point with the predetermined time left to the deadline for the bets in the time period.

13. A method for playing a gaming machine, the method comprising the steps of:

displaying on a shared display device a racing game in which a plurality of characters race against each other;

receiving, by a gaming terminal, a bet made by a player regarding an order of arrival of the plurality of characters in the racing game;

periodically summing up bets made by players and received by the gaming terminal;

periodically calculating the latest value of odds for the racing game based on the latest sum-up result of the bets;

displaying an effect value of the odds for the racing game on an individual display of the gaming machine; and setting the effect value smaller than the latest value by a predetermined rate in a time period with more than predetermined time left to a deadline for the bets.

14. The method for playing a gaming machine according to claim 13, further comprising the step of:

gradually changing the predetermined rate to a smaller value as time approaches a point with the predetermined time left to the deadline for the bets in the time period.

15. The method for playing a gaming machine according to claim 13, further comprising the step of:

gradually changing a value of the predetermined rate so as to allow the effect value to approach the latest value as time approaches a point with the predetermined time left to the deadline for the bets in the time period.

16. A method for playing a gaming machine, the method comprising the steps of:

displaying on a shared display device a racing game in which a plurality of characters race against each other;

receiving, by a gaming terminal, a bet made by a player regarding an order of arrival of the plurality of characters in the racing game;

periodically summing up bets made by player and received by the gaming terminal;

periodically calculating the latest value of odds for the racing game on the basis of the latest sum-up result of the bets;

displaying an effect value of the odds for the racing game on the shared display device and an individual display of the gaming machine; and setting the effect value smaller than the latest value by a predetermined rate in a time period with more than predetermined time left to a deadline for the bets.

17. The method for playing a gaming machine according to claim 16, further comprising the step of:

gradually changing the predetermined rate to a smaller value as time approaches a point with the predetermined time left to the deadline for the bets in the time period.

18. The method for playing a gaming machine according to claim 16, further comprising the step of:

gradually changing a value of the predetermined rate so as to allow the effect value to approach the latest value as time approaches a point with the predetermined time left to the deadline for the bets in the time period.

* * * * *